United States Patent [19]

Asano et al.

[11] 4,398,753

[45] Aug. 16, 1983

[54] PRESSURE SENSITIVE RECORDING UNIT

[75] Inventors: Makoto Asano; Kiyoharu Hasegawa; Hiroyuki Akahori, all of Yokohama; Michihiro Tsujimoto, Tachikawa, all of Japan

[73] Assignee: Mitsui Toatsu Chemicals, Incorporated, Tokyo, Japan

[21] Appl. No.: 330,325

[22] Filed: Dec. 14, 1981

[30] Foreign Application Priority Data

Dec. 26, 1980 [JP] Japan ..... 55-183878
Oct. 30, 1981 [JP] Japan ..... 56-172787

[51] Int. Cl.[3] ..... B41L 1/20

[52] U.S. Cl. ..... 282/27.5; 427/150; 427/151; 427/152; 428/320.4; 428/320.6; 428/320.8; 428/914

[58] Field of Search ..... 282/27.5; 427/150, 151, 427/152; 428/320.4, 320.8, 913, 914, 411, 537

[56] References Cited

U.S. PATENT DOCUMENTS 4,154,463 5/1979 Burri ..... 282/27.5

4,254,032 3/1981 Petitpierre et al. ..... 282/27.5

*Primary Examiner*—Bruce H. Hess

*Attorney, Agent, or Firm*—Fisher, Christen & Sabol

[57] ABSTRACT

Disclosed is a pressure sensitive recording unit which comprises a single base web sheet and a methine-type dyestuff and an organic oxidizing compound both supported on the single base web sheet, or a combination of first and second base web sheets and the methine-type dyestuff and organic oxidizing compound supported individually on the first and second base web sheets. Such a recording unit includes for example a pressure sensitive recording unit formed in combination of (a) a back-coated topsheet (CB-sheet) making use of microscopic capsules containing a solution obtained by dissolving a methine-type dyestuff in a solvent having a high boiling point and (b) a front-coated undersheet (CF-sheet) carrying an organic oxidizing compound coated thereon. Also disclosed is a pressure sensitive recording unit which includes a base web sheet carrying thereon such a methine-type dyestuff together with a metal ion sequestering agent and/or alkanol amine.

12 Claims, No Drawings

PRESSURE SENSITIVE RECORDING UNIT

BACKGROUND OF THE INVENTION (1) Field of the Invention

This invention relates to a novel pressure sensitive recording unit making use of a coloration reaction through oxidation. More specifically, it relates to a novel pressure sensitive recording unit which, when applied as pressure sensitive recording paper, can provide pressure sensitive recording paper extremely superior in quality to pressure sensitive recording paper which relies on an acid-base coloration reaction.

(2) Description of the Prior Art

The pressure sensitive recording system has already been completed on the basis of electron donative colorless chromogenic compounds and acidic color-developing materials while using such colorless chromogenic compounds in the form of microscopic capsules enclosing oil droplets which in turn contain one or more of such colorless chromogenic compounds dissolved therein. It is now sold as pressure sensitive recording paper. It has established a wide-spread commercial utility for chits, slips and vouchers because it does not smudge hands and clothing, contrary to conventionally employed carbon paper.

Accompanied with the improved efficiency and manpower cutting in office work and popularization of computers, the adoption of such pressure sensitive recording paper has been promoted for a wide variety of applications. Recent increase in its sales is remarkable.

Pressure sensitive recording sheet is prepared by disposing a sheet coated with microscopic capsules enclosing fine droplets of a hydrophobic, non-volatile solvent which contains an electron donative colorless chromogenic compounds (hereinafter referred to simply as "pressure sensitive dyestuff") dissolved therein (said sheet is generally called "back-coated topsheet" and will hereinafter be abbreviated to "CB-sheet") and another sheet coated with a coating composition containing an acidic color-developing agent (called generally "front-coated undersheet" and will hereinafter be shortened to "CF-sheet") with their coated surfaces confronting each other so that the microscopic capsules can be ruptured by writing, marking or typing pressures exerted thereon through hand-writing or by means of a typewriter or any of various mechanical printers to release the pressure sensitive dyestuff-containing solution, which upon contact with the acidic color-developing agent undergoes a chemical reaction, whereby producing a color and thus a recorded image. Therefore, it is possible to make a number of copies by alternatingly superposing layers of microscopic capsules and layers of a color-developing agent.

In addition to the above-described pressure sensitive recording sheet, other pressure sensitive recording sheets of varied structures have been put to practical use and suitably selected depending on their application fields. Among such pressure sensitive recording sheets, may be mentioned a single-sheet type pressure sensitive recording sheet (hereinafter abbreviated to "SC-sheet") which is obtained by applying onto a same surface of a sheet both microscopic capsule layer and color-developing layer in two layers or coating on a surface of a sheet a mixture of such microscopic capsules and a color-developing agent so that the resulting sheet is provided with an ability to produce a color upon application of a pressure thereto in the form of either a single sheet or a plurality of superposed sheets; and a self-contained CB-sheet obtained by further coating such microscopic capsules on the back surface of the SC-sheet.

In pressure sensitive recording paper making use of such acid-base coloration systems, 3,3-bis-(4'-dimethylaminophenyl)-6-dimethylaminophthalide (common name: Crystal Violet Lactone, hereinafter abbreviated to "CVL") was initially employed as a pressure sensitive dyestuff by dissolving same in a hydrophobic solvent such as polychlorinated biphenyl or the like and then microencapsulating the thus-prepared CVL-containing solution. On the other hand, early-stage color-developing agents were led by clay minerals such as attapulgite. Since then, various improvements have been effected to both pressure sensitive dyestuffs and color-developing agents. As a result, the following pressure sensitive dyestuffs and acidic color-developing agents have been put to practical use: (1) pressure sensitive dyestuffs—a wide variety of fluorene dyestuffs, indolylphthalides and Rhodamine lactams, etc.; and (2) acidic color-developing agents—phenols and biphenols both of which may be substituted, oil-soluble acidic phenolic polymers, metal-modified phenolic polymers, derivatives of organic carboxylic acids, etc.

Although these extensively used pressure sensitive recording papers, which make use of an acid-base coloration system, are satisfactory in promptly providing deep images of various hues on CF-sheets by pressures such as writing pressures, they are on the other hand accompanied by serious common drawbacks that (1) the color fastness of developed images is not sufficient and developed images are extremely susceptible to vanishing, fading and/or discoloration during their storage over a long period of time, upon exposure to light, upon contact with an oxidizing compound (either liquid or gaseous) or solvent, especially, a polar solvent, and/or in the course of the ir storage at high temperatures; (2) the color-developing agents applied on CF-papers tend to give inconvenient yellow tinge or color to the CF-papers during their storage due to, presumably, an oxidation reaction and many of the color-developing agents tend to be deteriorated in their color-developing ability due to, also presumably, oxidation or adsorption of gases in the air; and (3) such pressure sensitive papers are costly since they use costly dyes and color-developing agents are coated in a great quantity on base web sheets such as papers. Accordingly, there is a standing desire for the development of a color-producing system overwhelmingly superior to those employed in the conventional pressure sensitive recording sheets and a pressure sensitive recording material making use of such a color-producing system.

A wide variety of substitutes for conventional pressure sensitive recording systems utilizing an acid-base coloration have been studied, including the following proposals:

(1) Use of a color-developing reaction through chelation between a metal salt and ligand (Japanese Patent Publication Nos. 28730/1969 and 5616/1970);

(2) Method making use of the color-producing phenomenon owing to the oxidation of diphenylmethane dyestuffs (Japanese Patent Publication No. 5625/1963);

(3) Pressure sensitive recording paper employing bis-(2,4-dinitrophenyl) acetate as a dyestuff precursor and an alkaline color-developing agent (U.S. Pat. No. 4,113,282);

(4) Attempted application of the color-producing reaction through the formation of a charge-transfer complex in pressure sensitive recording paper (Tappi 56, No. 8, 1975, PP 128–132);

(5) Application of a coupling reaction of a diazo compound in pressure sensitive recording paper (Japanese Patent Publication No. 32368/1974; Japanese Patent Laid-open No. 85811/1976).

However, none of the above proposals have been found successful for the following reasons (the item numbers in brackets correspond to the item numbers of the above proposals):

(1) It is difficult to obtain sharp images of various colors, except for black color. If the materials used for inducing the chelate reaction are water-soluble substances, water-in-oil type microscopic capsules are required and problems are thus encountered regarding the preparation of such microscopic capsules, their application onto base web sheets and the quality of resulting pressure sensitive recording paper. Moreover, ligands used in chelate reactions are generally liable to decomposition coloration through their oxidation or reduction by heat, light, moisture, etc. Therefore, pressure sensitive recording paper according to proposal (1) has not been used extensively;

(2) This proposal is not suitable for practical use as the diphenyl methane dyestuffs have considerable sublimability, the density of produced colors is not sufficient and produced color images are unstable (namely, tend to discolor or fade) during their storage;

(3) Pressure sensitive recording paper according to proposal (3) suffers from an extremely slow color-producing speed, whereby making itself unsuitable for practical use;

(4) The color-producing reaction takes place through the formation of a complex by a donor (electron donor) of a charge-transfer complex and its acceptor (electron acceptor). Therefore, resulting pressure sensitive recording paper involves such problems that the density of a produced color is low and developed color images have extremely low stability to light or heat. Such pressure sensitive recording paper is accordingly not suitable for practical use; and (5) Pressure sensitive recording paper according to proposal (5) is difficult to produce a blue~black hue which is generally preferred. It also involves problems with respect to color-developing speed storage and resistance to light. Thus, it has not been put to practical use.

In pressure sensitive recording paper comprising an acid-base coloration system, namely, CVL and an acidic color-developing agent, particularly, an acid clay type color-developing agent such as acid clay per se, benzoylleucomethylene blue (BLMB) is additionally incorporated to suppress the phenomenon that developed color images are faded too early. However, the incorporation of BLMB is accompanied by another drawback that, since this dyestuff produces a greenish blue color, the hue of a color image developed on a CF-sheet coated with acid clay tends to become greenish along the passage of time as CVL is faded. As a countermeasure for the above drawback, it was proposed to use a methine-type dyestuff represented by a triphenylmethane dyestuff in conjunction with CVL (see, Japanese Patent Publication Nos. 5134/1959 and 11991/1966). However, many of these methine-type dyestuffs are extremely unstable during their storage. Therefore, a microscopic capsule suspension prepared for their application in pressure sensitive recording paper is considerably colored during its microencapsulation step. In addition, upon exposure to light, pressure sensitive recording paper coated with such microscopic capsules tends to readily develop a color by itself. For these reasons, the incorporation of such methine-type dyestuffs has not been carried out in an industrial scale. Moreover, such triphenylmethane dyestuffs have been considered to be absolutely unsuitable as color reactants for practical application because their color-producing speeds upon contact with an acidic color-developing agent (acid clay, attapulgite, phenol-formaldehyde polymer, or the like) is extremely slow (see, for example, Hiroyuki Moriga, "Introduction to Chemistry of Special Paper", Kobunshi-Kankokai, Kyoto, Japan, 1975, P 46).

On the other hand, methine-type dyestuffs having at one or more portion thereof one or more heterocyclic rings of a large molecular weight are relatively stable during storage thereof. It has also been proposed to employ such a methine-type dyestuff as an auxiliary color reactant used together with CVL for pressure sensitive recording paper, in combination with an acid clay-type color-developing agent. However, methine-type dyestuffs of this sort suffer from extremely slow color-producing speeds thereof.

Moreover, the acid clay, a color-developing agent, per se has tendency of lowering its color-producing ability along the passage of time. These problems have not been solved at all. Thus, they have not become a drastic solution to the problems of conventional pressure sensitive recording paper which depends on an acid-base color-producing system.

SUMMARY OF THE INVENTION

An object of this invention is to provide a pressure sensitive recording unit which makes use of a novel color-producing system owing to an oxidation-reduction reaction between a methine-type dyestuff and an acidic organic compound.

Another object of this invention is to provide a pressure sensitive recording unit which promptly produces a color by pressures such as typing, writing or marking pressures and gives a developed image of a deep color, which exhibits extremely great resistance to light, solvent and heat and then has particularly good color fastness.

A further object of this invention is to provide a pressure sensitive recording unit having excellent properties such that the surface of a CF-sheet, which surface is coated with a color-developing agent, in other words, a layer containing an acidic organic compound does not have tendency of being inconveniently colored yellow along the passage of time and the CF-sheet does not show deteriorated color-producing ability during its storage; and the dyestuff-containing layer of a CB-sheet, that is to say, the layer containing microscopic capsules of a methine-type dyestuff does not tend to be tinged or colored by light.

A still further object of this invention is to provide a pressure sensitive recording unit having a big advantage from industrial viewpoint that the consumption of dyestuffs and color-developing agents can be reduced considerably in comparison with the conventional acid-base color-producing system.

According to the present invention, the following pressure sensitive recording unit is provided:

A pressure sensitive recording unit comprising a single base web sheet and a methine-type dyestuff and organic oxidizing compound both supported on the single base web sheet; or a combination of first and second base web sheets and the methine-type dyestuff and organic oxidizing compound supported individually on the first and second base web sheets.

The incorporation of (1) an alkanol amine, (2) a metal ion sequestering agent, or (3) the alkanol amine and metal ion sequestering agent in the layer containing the methine-type dyestuff has made it possible to apply methine-type dyestuffs, which are extremely unstable during their storage and have thus not been used in pressure sensitive recording papers, to pressure sensitive recording units.

In another aspect of this invention, it is possible to support, together with a methine-type dyestuff, (1) an alkanol amine, (2) a metal ion sequestering agent, or (3) the alkanol amine and metal ion sequestering agent on a base web sheet such as paper or the like. For example, by adding the alkanol amine and/or metal ion sequestering agent to the methine-type dyestuff in either one of the steps from the preparation of microscopic capsules of the methine-type dyestuff until the application of a suspension of such microscopic capsules onto the base web sheet or by coating a layer of such a dyestuff-containing microscopic capsule suspension and another layer of the alkanol amine and metal ion sequestering agent separately onto the base web sheet, (1) the alkanol amine, (2) a metal ion sequestering agent, or (3) both alkanol amine and metal ion sequestering agent are allowed to present in the layer containing the methine-type dyestuff (which is generally a layer of microscopic capsules enclosing a hydrophobic solvent which in turn contains a methine-type dyestuff dissolved therein), thereby stabilizing the methine-type dyestuff which is sensitive to the environment and liable to easy coloration and, therefore, minimizing the coloration of the dyestuff-containing layer through its oxidation due to its storage over a long time period or its exposure to light. Thus, the quality of pressure sensitive recording units according to this invention has reached a sufficiently merchantable level.

Pressure sensitive recording units according to this invention have a number of advantages as described below. Namely, when a methine-type dyestuff and an organic oxidizing compound are brought into contact by physical means, the methine-type dyestuff is promptly oxidized to a deep cationic dyestuff, whereby producing a color image. More specifically, when a CB-sheet carrying thereon a layer containing microscopic capsules of a solution which has been obtained by dissolving a methine-type dyestuff in a solvent of a high melting point is combined with a CF-sheet carrying thereon a layer containing an organic oxidizing compound and the microscopic capsules are ruptured by pressures so as to cause the methine-type dyestuff in the solution to contact with the organic oxidizing compound to produce a color, a deep color image is promptly formed with an oxide of the methine-type dyestuff used. The thus-obtained color image is extremely fast and (1) does not substantially fade even if exposed to light; (2) does not vanish at all through the contact with polar solvents such as esters; (3) does not discolor or fade at all even when stored over a long period of time; and (4) does not vanish even when heated.

They do not develop any deleterious phenomena such as yellowing or coloration of the surfaces coated with such a conventional acidic organic color-developing agent and weakening of its color-producing ability due to its oxidation upon exposure to light or during storage over a long time period, which phenomena have been considered to be very serious problems for pressure sensitive recording papers coated with a conventional acidic organic color-developing agent.

Moreover, it is possible to considerably reduce the quantity of a dyestuff or color-developing agent required per unit area, compared with conventional pressure sensitive recording papers which make use of an acid-base color-producing system.

There has been a considerable limitation to solvents usable for the production of such pressure sensitive recording papers, since microscopic capsules of phthalide dyestuffs and fluorene dyestuffs, which are currently employed in pressure sensitive recording sheets of the acid-base color-producing system, are impeded in their ability to produce colors by various hydrophobic solvents of a high boiling point such as esters and ethers used as solvents for such dyestuffs. However, when a methine-type dyestuff is employed in accordance with this invention, the above solvents can be used for the methine-type dyestuff without adversely affecting various properties of pressure sensitive recording papers. Thus, the range of usable solvents can be broadened substantially and a suitable solvent can be selected from such a wide variety of solvents by taking into consideration its solubility to the dyestuff and color-developing agent and its cost.

DETAILED DESCRIPTION OF THE INVENTION

The methine-type dyestuffs usable in the present invention are a group of colorless or pale-colored chromogenic compounds represented by the general formula (I):

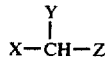

(I)

wherein, X, Y and Z represent individually a phenyl, naphthyl, or β-styryl group or a residue of an aromatic heterocyclic ring which group or ring may optionally be substituted, X, Y and Z may be the same or different, either two of X, Y and Z may be coupled together to form a ring, and, when not more than one of X, Y and Z is the residue of the aromatic heterocylic ring, the phenyl, naphthyl or β-styryl group contains at least one amino group, substituted amino group or lower alkoxy group at the para-position with respect to the central methine group of its molecule. In the general formula (I), exemplary aromatic heterocyclic rings may include those having either one of the following skelton structures but shall not be limited thereto:

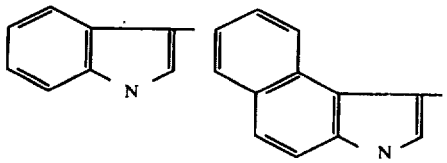

-continued

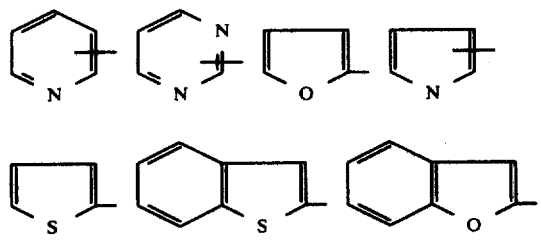

On the other hand, exemplary substituent group or groups which may be united to one or more carbon or hetero atoms in the phenyl, naphthyl or β-styryl group or a residue of an aromatic heterocyclic ring include halogen atoms; lower alkyl, acyl, carboalkoxy, cyanoalkyl, cyano, hydroxyl and nitro groups; phenyl, aralkyl, aryloxy and aralkylalkoxy groups which may optionally be substituted; amino group; substituted amino groups having as substituent group or groups one or two lower alkyl, cycloalkyl, cyanoalkyl, halogenated alkyl and/or hydroxyalkyl groups and/or aryl and/or aralkyl groups which may optionally be substituted (where both hydrogen atoms of the amino group are substituted, the substituent groups which attach to the remaining nitrogen atom of the amino group may be the same or different); polymethylene amino groups (for example, pyrrolidino and piperidino groups); and morpholino groups. The substituent groups may be coupled together to form a ring.

Specific examples of methine-type dyestuffs usable in the present invention are as follows:

(A) Triphenylmethane dyestuffs (A-1) Triaminotriphenylmethane dyestuffs:

4,4',4''-tris-dimethylamino-triphenylmethane;
4,4',4''-tris-diethylamino-triphenylmethane;
4,4'-bis-methylamino-4''-dimethylamino-triphenylmethane;
4,4'-bis-methylamino-4''-methylamino-triphenylmethane;
4,4'-bis-diethylamino-4''-ethylamino-triphenylmethane;
4,4'-bis-diethylamino-4''-amino-triphenylmethane;
4,4'-bis-dimethylamino-3''-methyl-4-amino-triphenylmethane;
4,4'-bis-dimethylamino-3''-methyl-4-methylamino-triphenylmethane;
4,4',4''-tris-phenylamino-triphenylmethane;
4,4',4''-tris-(N-methyl-N-phenyl-amino)-triphenylmethane;
4,4'-bis-morpholino-4''-dimethylamino-triphenylmethane;
4,4',4''-tris-dimethylamino-2,2'-dimethyl-triphenylmethane;
4,4',4''-tris-dimethylamino-3,3'-dimethyl-triphenylmethane;
4,4',4''-tris-dimethylamino-2-methoxy-triphenylmethane;
4,4',4''-tris-dimethylamino-3-methyl-triphenylmethane;
4,4'-bis-dimethylamino-4''-N-benzylamino-triphenylmethane;
4,4'-bis-dimethylamino-4''-N-benzylamino-3''-methoxy-triphenylmethane;
4,4'-bis-dimethylamino-4''-N-benzylamino-3''-methyl-triphenylmethane;
4,4'-bis-dimethylamino-3''-chloro-4''-N-benzylamino-triphenylmethane;
4,4-bis-dimethylamino-4''-(N-benzyl-N-methylamino)-triphenylmethane;
4,4'-bis-dimethylamino-4''-(N-o-chlorobenzyl-N-methylamino)-triphenylmethane;
4,4'-bis-dimethylamino-4''-(N-p-chlorobenzyl-N-methylamino)-triphenylmethane;
4,4'-bis-dimethylamino-4''-(N-p-methylbenzyl-N-methylamino)-triphenylmethane;
4,4'-bis-dimethylamino-4''-(N,N-dibenzylamino)-triphenylmethane;
4,4'-bis-dimethylamino-4''-(N-phenyl-N-methylamino)-triphenylmethane;
4,4'-bis-dimethylamino-4''-morpholino-triphenylmethane;
4,4'-bis-N-benzylamino-4''-dimethylamino-triphenylmethane;
4,4'-bis-(N-benzyl-N-methylamino)-4''-dimethylamino-triphenylmethane;
4,4'-bis(N-p-chlorobenzyl-N-methylamino)-4''-diethylamino-triphenylmethane;
4,4'-bis(N-p-bromobenzyl-N-ethylamino)-4''-diethylamino-triphenylmethane;
4,4'-bis-pyrrolidyl-4''-dimethylamino-triphenylmethane;
4,4'-bis-(N-o-chlorobenzyl-N-methylamino)-4''-dimethylamino-triphenylmethane;
4,4'-bis-pyrrolidyl-4''-(N-benzyl-N-methylamino)-triphenylmethane;
3,3'-dichloro-4,4'-bis-(N-benzylamino)-4''-dimethylamino-triphenylmethane;
4,4'-bis-(N-p-methylbenzyl-N-methylamino)-4''-dimethylamino-triphenylmethane;
4,4'-bis-(N-p-methylbenzyl-N-ethylamino)-4''-diisopropylamino-triphenylmethane;
3,3-dimethyl-4,4'-bis-(p-methylbenzylamino)-4''-dimethylamino-triphenylmethane;
3,3-dimethyl-4,4'-bis-(N-benzylamino)-4''-dimethylamino-triphenylmethane; and
3,3-dibutyl-4,4'-bis-N-benzylamino-4''-diethylamino-triphenylmethane.

(A-2) Diaminotriphenylmethane dyestuffs:

4,4'-bis-dimethylamino-triphenylmethane;
4,4'-bis-dimethylamino-4''-methyl-triphenylmethane;
4,4'-bis-(N-benzyl-N-ethylamino)-triphenylmethane;
4,4'-bis-dimethylamino-2-chloro-triphenylmethane;
4,4'-bis-diisopropylamino-3''-bromotriphenylmethane;
4,4'-bis-dimethylamino-4''-methoxy-triphenylmethane;
4,4'-bis-dimethylamino-4''-ethoxy-triphenylmethane;
4,4'-bis-dimethylamino-3''-methyl-4''-methoxytriphenylmethane;
4,4'-bis-dimethylamino-3''-methyl-4''-ethoxytriphenylmethane;
4,4'-bis-dimethylamino-3'',4''-dimethoxytriphenylmethane;
4,4'-bis-dimethylamino-2'',4''-dimethoxytriphenylmethane;
4,4'-bis-diethylamino-3''-ethyl-4''-ethoxytriphenylmethane;
4,4'-bis-methylamino-3,3-dimethyl-3''-butyl-4''-butoxytriphenylmethane;
4,4'-bis-dimethylamino-3''-cyclohexyl-4''-methoxy-triphenylmethane;
4,4'-bis-propylamino-3''-phenyl-4'-propoxytriphenylmethane;
4,4'-bis-(N-benzyl-N-methylamino)-3''-propyl-4'-methoxy-triphenylmethane;
4,4'-bis-(N-benzyl-N-methylamino)-3''-methyl-4''-ethoxy-triphenylmethane;

4,4'-bis-N-pyrrolidyl-3''-methyl-4''-methoxy-triphenylmethane;
4,4'-bis-N-piperidyl-3''-methyl-4''-ethoxy-triphenylmethane;
4,4'-bis-(dimethylamino)-3''-tert. butyl-4''-methoxy-triphenylmethane; and
4,4'-bis-(dimethylamino)-3'',4'',5''-trimethoxyphenyl methane.

(A-3) Monoaminotriphenylmethane dyestuffs:

4,4'-dimethoxy-4''-dimethylamino-triphenylmethane;
4,4'-dimethoxy-3''-methyl-4''-methylamino-triphenylmethane;
4,4'-diethoxy-4''-diethylamino-triphenylmethane;
4,4'-dimethoxy-4''-(N-benzyl-N-methylamino)-triphenylmethane;
3,3'-dimethyl-4,4'-dimethoxy-4''-dimethylamino-triphenylmethane;
4,4'-dimethoxy-4''-pyrrolidino-triphenylmethane;
4,4'-dimethyl-4''-diethylamino-triphenylmethane; and
4-methoxy-4'-diethylamino-triphenylmethane.

(B) Naphthylmethane dyestuffs bis-(4-dimethylamino-naphthyl-1)-4'-dimethylamino-phenylmethane;
bis-(4-ethylamino-naphthyl-1)-4'-dimethylamino-phenylmethane;
bis-(4-N-paratolyl-N-methylamino-naphthyl-1)-4'-isopropylamino-phenylmethane;
tris-(4-dimethylamino-naphthyl-1)-methane;
bis-(4-dimethylamino-naphthyl-1)-4'-N-morpholino-phenylmethane;
bis-(4-N-benzylaminophenyl)-1-naphthylmethane;
bis-(4-diethylaminophenyl)-4'-N-phenylaminonaphthyl-1-methane;
bis-(4-diethylaminophenyl)-4'-ethylnaphthyl-1-methane;
bis-(4-N-phenyl-N-methylnaphthyl-1)-β-styrylmethane;
bis-(4-dimethylamino-naphthyl-1)-p-chlorostyrylmethane;
bis-(4-dimethylaminophenyl)-2'-methyoxynaphthyl-1-methane;
bis-(4-dimethylaminophenyl)-4'-methoxynaphthyl-1-methane;
bis-(4-dimethylaminophenyl)-naphthyl-2-methane;
bis-(4-N-propylphenyl)-4'-propoxynaphthyl-2-methane;
bis-(4-dimethylaminonaphthyl-1)-2-pyridylmethane;
bis-(4-dimethylaminonaphthyl-1)-2'-pyridylmethane; and
bis-(4-dibenzylaminonaphthyl-1)-quinolin-3'-yl-methane.

(C) Diphenyl-β-styrylmethane dyestuffs bis(4-dimethylaminophenyl)-β-styrylmethane;
bis(3-methyl-4[N-phenylamino]phenyl)-β-styrylmethane;
bis(4[N-benzyl-N-methylamino]phenyl)-β-styrylmethane;
bis(4-dimethylaminophenyl)-β-(4'-dimethylaminostyryl)methane;
bis(4-dimethylaminophenyl)-β-(4'-methoxystyryl)-methane;
bis(4-diethylaminophenyl)-β-(3'-methyl-4'-ethoxystyryl)-methane;
bis(3-methyl-4'-ethoxyphenyl)-β-(4'-diethylaminostyryl)-methane; and
4-methylphenyl-4'-diethylaminophenyl-β-(3'-tert. butyl-4'-dimethylaminostyryl)-methane.

(D) Indolylmethane dyestuffs phenyl-bis-(1-ethyl-2-methylindol-3-yl)-methane;
4-methoxyphenyl-bis-(1'-ethyl-2'-methylindol-3'-yl)-methane;
3-methyl-4-methoxyphenyl-bis-(1'-ethyl-2'-methylindol-3'-yl)-methane;
3,4-dimethoxyphenyl-bis-(1'-ethyl-2'-methylindol-3'-yl)-methane;
2,4-dimethoxyphenyl-bis-(1'-ethyl-2-methylindol-3'-yl)-methane;
3,4-diethoxyphenyl-bis-(1'-ethyl-2'-methylindol-3'-yl)-methane;
3-butyl-4-methoxyphenyl-bis-(1'-butyl-2'-methylindol-3'-yl)-methane;
4-ethoxyphenyl-bis-(1'-ethyl-2'-phenylindol-3'-yl)-methane;
4-ethoxyphenyl-bis-(1'-ethyl-2'-methylindol-3'-yl)-methane;
phenyl-bis-(1'-n-butyl-2'-methylindol-3'-yl)-methane;
phenyl-bis-(1'-methyl-2'-phenylindol-3'-yl)-methane;
bis-(4-dimethylaminophenyl)-(1'-ethyl-2'-methylindol-3'-yl)-methane;
bis(1-ethyl-2-methylindol-3-yl)-2'-naphthylmethane;
bis-(1-ethyl-2-methylindol-3-yl)-1'-naphthylmethane;
tris-(1-ethyl-2-methylindol-3-yl)-methane;
tris-(1-n-butyl-2-methylindol-3-yl)-methane;
bis-(1-ethyl-2-methylindol-3-yl)-3'-chloro-4'-methoxy-phenylmethane;
bis-(1-carboxyethyl-2-methylindol-3-yl)-phenylmethane;
bis-(1-propyl-2-phenylindol-3-yl)-phenylmethane;
bis-(1-octyl-2-methylindol-3-yl)-phenylmethane;
bis-(1-benzyl-2-methylindol-3-yl)-phenylmethane;
bis-(1-ethyl-2-methylindol-3-yl)-2'-methylphenylmethane;
bis-(1-ethyl-2-methylindol-3-yl)-3'-methylphenylmethane;
bis-(1-ethyl-2-methylindol-3-yl)-4'-methylphenylmethane;
bis-(1-ethyl-2-methylindol-3-yl)-2'-methoxyphenylmethane;
bis-(1-ethyl-2-methylindol-3-yl)-4'-fluorophenylmethane;
bis-(1-ethyl-2-methylindol-3-yl)-4'-bromophenylmethane;
bis-(1-hexylindol-3-yl)-phenylmethane;
bis-(1-ethyl-2-methylindol-3-yl)-3'-nitrophenylmethane;
bis-(1-ethyl-2-methylindol-3-yl)-3',4'-dichloro-phenylmethane;
bis-(1-ethyl-2-methylindol-3-yl)-2'-thienylmethane;
bis-(1-ethyl-2-methylindol-3-yl)-1'-methyl-2'-thienylmethane; and
bis-(1-butyl-2-methylindol-3-yl)-4'-pyridylmethane.

(E) Other methine-type dyestuffs 3,6-bis-dimethylamino-9-phenylxanthene;
3,6-bis-diethylamino-9-phenylxanthene;
3,6-bis-dimethylamino-9-(3'-methyl-3'-dimethylamino-phenyl)-xanthene;
3-diethylamino-6,7-dimethyl-9-phenylxanthene;
3,6-dimethoxy-9-(4'-dimethylaminophenyl)-xanthene;
3,6-diethoxy-9-(4'-dimethylnaphthyl-1')-xanthene;
3,6-bis-[N-methyl-N-phenylamino]-9-(3',4'-dimethoxy-phenyl)-xanthene;
3,6-bis-dimethylamino-9-phenylthioxanthene;
3,6-dimethylamino-9-(4'-methoxyphenyl)-10-methyl-9,10-dihydroacridine; and 3,6-bis-dimethylamino-9-(4'-dimethylaminophenyl)-fluorene.

Needless to say, the methine-type dyestuffs are not limited to the specific compounds exemplified above.

Among the groups of methine-type dyestuffs mentioned above, the triphenylmethane, naphthylmethane and diphenyl-$\beta$-styrylmethane dyestuffs are preferred. The triphenylmethane dyestuffs are particularly preferred.

The organic oxidizing compound used in a pressure sensitive recording unit according to this invention can promptly oxidize the methine-type dyestuff represented by the general formula (I) and produce an image of a deep color with the thus-prepared cationic dyestuff on the surface of a pressure sensitive recording paper. Preferable organic oxidizing compounds are those having an oxidation-reduction potential at 0.4 eV or higher and being soluble in organic solvents. It is effective to use as compounds having a high oxidation-reduction potential quinone derivatives substituted by many electron attractive groups, for example, benzoquinone derivatives. Since such quinone derivatives are required to remain stably on a surface of a pressure sensitive recording sheet, it is not preferable to use quinone derivatives having a low molecular weight or sublimability.

Specific examples of such quinone derivatives include:

(A) Benzoquione derivatives represented by the general formula (II) or (III)

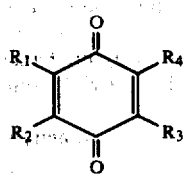

(II)

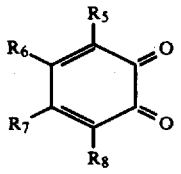

(III)

wherein, at least two Rs of each of $R_1$–$R_4$ and $R_5$–$R_8$ are selected from the group consisting of halogen atoms and cyano, nitro, carboxy, alkoxycarbonyl, aryloxycarbonyl, aralkyloxyoxycarbonyl, alkylsulphonyl, arylsulphonyl, aralkylsulphonyl, alkoxysulphonyl, aryloxysulphonyl, aralkyloxyoxysulphonyl and acyl groups, remaining Rs are selected from the group consisting of hydrogen atom and alkyl, aryl, aralkyl, alkoxy, aryloxy, aralkyloxy, alkylthio and arylthio groups, and adjacent carboxyl groups may form an imido-ring. Such benzoquinones are for example as follows:

2,3-dicyano-5,6-dichloro-1,4-benzoquinone;
2,3,5,6-tetracyano-1,4-benzoquinone;
3,4-dibromo-5,6-dicyano-1,2-benzoquinone;
3,4,5,6-tetracyano-1,2-benzoquinone;
2,3,5,6-tetrabromo-1,4-benzoquinone;
2,3,5,6-tetraiodo-1,4-benzoquinone;
2,3,5,6-tetramethoxycarbonyl-1,4-benzoquinone;
2,3,5,6-tetraethoxycarbonyl-1,4-benzoquinone;
2,3,5,6-tetra-i-butoxycarbonyl-1,4-benzoquinone;
2,3,5,6-tetra-n-hexyloxycarbonyl-1,4-benzoquinone;
2,3,5,6-tetra-(2'-ethylhexyloxycarbonyl)-1,4-benzoquinone;
2,3,5,6-tetra-dodecyloxycarbonyl-1,4-benzoquinone;
2,3,5,6-tetraphenoxycarbonyl-1,4-benzoquinone;
2,3,5,6-tetra-p-toluyloxycarbonyl-1,4-benzoquinone;
2,3,5,6-tetrabenzyloxycarbonyl-1,4-benzoquinone;
2,3,5,6-tetranaphthoxycarbonyl-1,4-benzoquinone;
3,4,5,6-tetrapropyloxycarbonyl-1,2-benzoquinone;
3,4,5,6-tetra-n-butoxycarbonyl-1,2-benzoquinone;
2,5-dimethoxycarbonyl-3,6-dichloro-1,4-benzoquinone;
2,5-diethoxycarbonyl-3,6-dibromo-1,4-benzoquinone;
2,5-di-i-butoxycarbonyl-3,6-dibromo-1,4-benzoquinone;
2,5-di-n-octoxycarbonyl-3,6-dibromo-1,4-benzoquinone;
2,5-diphenoxycarbonyl-3,6-diiodo-1,4-benzoquinone;
2,5-dibenzyloxy-3,4-dichloro-1,2-benzoquinone;
3,6-di-n-pentyloxycarbonyl-3,4-dichloro-1,4-benzoquinone;
2,5-dibenzoyl-3,6-dichloro-1,4-benzoquinone;
2,5-dibenzoyl-3,6-dibromo-1,4-benzoquinone;
2,5-dibenzoyl-3-bromo-1,4-benzoquinone;
2,5-diacetyl-3,6-dibromo-1,4-benzoquinone;
2,5-diethoxycarbonyl-3,6-diphenylsulphonyl-1,4-benzoquinone;
2,5-di-n-butoxycarbonyl-3,6-di-4'-tolylsulphonyl-1,4-benzoquinone;
2,5-di-n-hexyloxycarbonyl-3,6-diphenylsulphonyl-1,4-benzoquinone;
2,5-di-i-ethylsulphonyl-3,6-di-p-tolylsulphonyl-1,4-benzoquinone;
2,5-di-i-butoxycarbonyl-3,6-di-p-cyclohexylphenylsulphonyl-1,4-benzoquinone;
2,5-di-(2'-ethylhexyloxycarbonyl)-3,6-di-4'-diphenylsulphonyl-1,4-benzoquinone;
2,5-di-n-propyloxycarbonyl-3,6-di-4'-chlorophenylsulphonyl-1,4-benzoquinone;
2,5-diethoxycarbonyl-3,6-di-4'-methoxyphenylsulphonyl-1,4-benzoquinone;
2,5-di-benzyloxycarbonyl-3,6-di-4'-tolylsulphonyl-1,4-benzoquinone;
2,5-di-n-oxtyloxycarbonyl-3,6-diethylsulphonyl-1,4-benzoquinone;
2,5-diethoxycarbonyl-3,6-(2'-naphthylsulphonyl)-1,4-benzoquinone;
2,5-dimethoxycarbonyl-3-toluylsulphonyl-1,4-benzoquinone;
3,6-diethoxycarbonyl-4,5-diphenylsulphonyl-1,2-benzoquinone;
2,3,5,6-tetra-4'-toluylsulphonyl-1,4-benzoquinone;
2,3,5,6-tetraphenylsulphonyl-1,4-benzoquinone;
2,3,5,6-tetraethylsulphonyl-1,4-benzoquinone;
3,4,5,6-tetra-i-butylsulphonyl-1,2-benzoquinone;
2,3,5,6-tetra-n-octylsulphonyl-1,4-benzoquinone;
2,3,5,6-tetrabenzyloxysulphonyl-1,4-benzoquinone;
2,5-di-n-propyloxycarbonyl-3,6-dibenzoyl-1,4-benzoquinone;
2,5-di-i-butoxycarbonyl-3-benzoyl-1,4-benzoquinone;
2,3-dichloro-5,6-dicarboxbutylimide-1,4-benzoquinone;
2,3,5,6-tetracarboxdiphenylimide-1,4-benzoquinone;
3,4,5,6-tetracabrboxdi-n-octylimide-1,2-benzoquinone;
2,5-diethoxysulphonyl-1,4-benzoquinone;
2,5-diphenoxysulphonyl-3,6-dichloro-1,4-benzoquinone;
2,5-di-n-butoxycarbonyl-3,6-dibutoxysulphonyl-1,4-benzoquinone;
2,5-di-p-toluylsulphonyl-3,6-dibromo-1,4-benzoquinone;
2,5-di-n-hexylsulphonyl-3,6-dichloro-1,4-benzoquinone.

(B) Diphenoquinone derivatives and stilbenequinone derivatives represented respectively by the general formulae (IV) and (V)

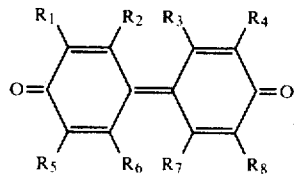

(IV)

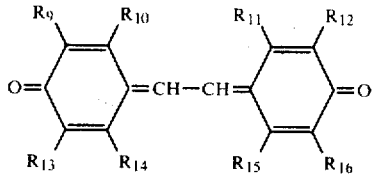

(V)

wherein, at least two Rs of each of $R_1$–$R_8$ and $R_9$–$R_{16}$ are selected from the group consisting of halogen atoms and cyano, nitro, carboxy, alkoxycarbonyl, aryloxycarbonyl, aralkyloxycarbonyl, alkylsulphonyl, aralkylsulphonyl, alkoxysulphonyl, aryloxysulphonyl, aralkyloxysulphonyl and acyl groups, remaining Rs are selected from the group consisting of hydrogen atom and alkyl, aralkyl, alkoxy, aryloxy, araklyloxy, alkylthio and arylthio groups, and adjacent carboxyl groups may form an imido-ring. Specific examples of such diphenoquinone and stilbenequinone derivatives are as follows:

3,3',5,5'-tetrachloro-4,4'-diphenoquinone;
3,3',5,5'-tetracyano-4,4'-diphenoquinone;
2,2',3,3',5,5',6,6'-octachloro-4,4'-diphenoquinone;
2,2',3,3'-tetracyano-5,5',6,6'-tetrabromo-4,4'-diphenonquinone;
3,3',5,5'-tetraethoxycarbonyl-4,4'-diphenoquinone;
3,3',5,5'-tetrabenzyloxycarbonyl-2,2',6,6'-tetrabromo-4,4'-diphenoquinone;
3,3',5,5'-tetra-p-toluylsulphonyl-4,4'-diphenoquinone;
3,3',5,5'-tetraethoxysulphonyl-4,4'-diphenoquinone;
3,3'-dipentyloxysulphonyl-5,5'-dipentyloxycarbonyl-4,4'-diphenoquinone;
3,3',5,5'-tetra-n-propyloxycarbonyl-2,2',6,6'-tetrachloro-4,4'-stilbenequinone;
2,2',3,3',5,5',6,6'-oxtachloro-4,4'-stilbenequinone; and
2,3-dichloro-2'c3'-dicarboxethylimide-4,4'-diphenoquinone.

(C) Naphthoquinone, naphthodiquinone and anthradiquinone derivatives substituted by a plurality of the electron attractive groups described above As an example, may be mentioned 2,3-dicyano-1,4-naphthoquinone.

It shall however not be construed that the organic oxidizing compounds be limited to the above specific examples. These organic oxidizing compounds are dissolved on pressure sensitive recording sheets in a solvent which contains a methine-type dyestuff, thereby causing the methine-type dyestuff to produce a color. Thus, it is preferable to select those having great solubility (both speed and degree of dissolution) to a solvent of a high boiling point to be employed. Accordingly, the color-developing agent is suitably chosen in view of its solubility to a dyestuff solvent to be used.

Among such color-developing agents, benzoquinone derivatives substituted by a plurality of electron attractive groups are preferred. Particularly preferred are 1,4-benzoquinone derivatives substituted by electron attractive groups at the 2-, 3-, 5- and 6-positions (exclusive of sublimable halogeno-1,4-benzoquinones), as described hereinafter.

However, even if a quinone derivative has been substituted by electron attractive groups and is a strong oxidant, it cannot provide, as is, any practically usable pressure sensitive recording sheets as far as it has a small molecular weight and is thus sublimable, for the reasons described below. As examples of such a quinone derivative, may be mentioned 2,3,5,6-tetrachloro-1,4-benzoquinone, 2,3,5,6-tetrafluoro-1,4-benzoquinone, 2,3,5-trichloro-1,4-benzoquinone, dichlorobenzoquinones and difluorobenzoquinones. These quinone derivatives are (1) gradually sublimated off from pressure sensitive recording sheets during their storage, thereby deteriorating the color-producing ability of the pressure sensitive recording sheets; (2) sublimated and react with the methine-type dyestuff present in a microscopic capsule layer, thereby giving an inconvenient tinge or color of the thus-oxidized dyestuff to the layer; and (3) sublimated into the working environment, thereby deleteriously affecting the air. Therefore, it is necessary to incorporate means to inhibit the sublimation of such quinone derivatives when they are actually employed for the production of pressure sensitive recording sheets.

These color-developing agents may be coated, as needed, together with an oil-absorptive inorganic compound on base web sheets so as to provide CF-sheets. As such an oil-absorptive inorganic compound, may be mentioned for example various inorganic metal oxides, compound metal oxides, metal hydroxides, silicates, sulfates and carbonates. These inorganic compounds preferably have large oil absorbancy and B.E.T. specific surface area. It is more preferable if they have an oxidation point indicating an ability to oxidize the methine-type dyestuff of the general formula (I).

The incorporation of such an oil-absorptive inorganic compound is effective to further improve the overall quality as pressure sensitive recording sheets, because it does not only considerably improve the color-producing ability (both the density of a produced color and its color fastness against light) but also improves the acceptability or compatibility of the coated surfaces of the pressure sensitive recording sheets to ink, thereby improving their applicability to a wide variety of printing or writing with ballpoint pens and fountain pens.

As more specific examples of such oil-absorptive inorganic compounds, may be mentioned water-insoluble, white or pale-colored powder of oxides and compound oxides, which may be added with a little amount of one or more of various alkali metal salts in the course of their preparation, hydroxides, sulfides, carbonates, silicates and sulfates of silicon, aluminum, magnesium, calcium, strontium, barium, zinc, titanium, zirconium, tin, bismuth, antimony, molybdenum, tungsten, manganese, rhenium, iron, ruthenium, palladium, osmium, rhodium, uranium, tellurium, etc. Among such oil-absorptive inorganic compounds, metal oxides and compound metal oxides are particularly useful. They may be obtained by calcining their corresponding acids, hydroxides, carbonates, ammonium salts, sulfates, nitrates, oxalates, etc. It is also possible to use montmorillonite-clay minerals, for example, natural clay minerals such as terra abla, activated clay, bentonite, Fuller's earth kaolin, talc, China clay and the like and synthetic clay minerals such as, for example, zeolite.

These metal compounds are suitably selected for their application onto CF-sheets together with the above-described organic oxidizing compound, since their properties such as specific surface area, oil-absorbancy, oxidizing ability and acid-base ability as well as the nature of rheology of resulting dispersion to be applied onto pressure sensitive recording sheets vary depending on conditions employed for their preparation.

These metal compounds may be used by causing the organic oxidizing compound to be carried on the surfaces thereof in accordance with an impregnation-adsorption method.

The following alkanolamines and metal ion sequestering agents may be employed in pressure sensitive recording units according to this invention;

(A) Alkanol amines:

Water-soluble alkanol amines represented by the general formula (VI):

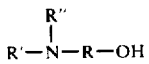

(VI)

wherein, R represents a lower alkylene group, an alkylene group having one or more hydroxyl groups or a polyoxyalkylene group having one or more hydroxyl groups, R' and R'' denote individually an alkyl, hydroxyalkyl, aryl, aralkyl, acyl or ω-hydroxyalkylpolyoxyalkylene group or an alkyl ether of an ω-hydroxyalkyl-polyoxyalkylene group, and R' and R'' may be coupled to form a ring. As specific examples of such alkanol amines, may be mentioned:

(1) Alkanol amines containing a tertiary amino group:

tris-N-(2-hydroxyethyl)amine;
tris-N-(2-hydroxypropyl)amine;
tris-N-(3-hydroxypropyl)amine;
tris-N-(hydroxybutyl)amine;
tris-N-(2,3-dihydroxypropyl-1)amine;
N,N-dimethyl-N-(2-hydroxyethyl)amine;
N,N-diethyl-N-(2-hydroxyethyl)amine;
N,N-dipropyl-N-(2-hydroxyethyl)amine;
N,N-dibutyl-N-(2-hydroxyethyl)amine;
N-methyl-N-phenyl-N-(2-hydroxyethyl)amine;
N,N-diphenyl-N-(2-hydroxyethyl)amine;
N,N-dimethyl-N-(2-hydroxypropyl)amine;
N,N-diethyl-N-(2-hydroxypropyl)amine;
N,N-dipropyl-N-(2-hydroxypropyl)amine;
N,N-dibutyl-N-(2-hydroxypropyl)amine;
N,N-diphenyl-N-(2-hydroxypropyl)amine;
N-methyl-N,N-di(2-hydroxyethyl)amine;
N-ethyl-N,N-di(2-hydroxyethyl)amine;
N-phenyl-N,N-di(2-hydroxyethyl)amine;
N-methyl-N,N-di(2-hydroxypropyl)amine;
N-acetyl-N,N-di(2-hydroxyethyl)amine;
N-acetyl-N,N-di(2-hydroxypropyl)amine;
N-hydroxyethylmorpholine;
N-hydroxypropylmorpholine;
N-tetradecyl-N,N-di(ω-hydroxyethylpolyoxyethylene)amine;
N-dodecyl-N,N-di(ω-hydroxyethylpolyoxyethylene)amine;
N-octadecyl-N,N-di(ω-hydroxyethylpolyoxyethylene)amine;
N,N-diodecyl-N-(ω-hydroxyethylpolyoxyethylene)amine;
N,N-di-cis-octadecenyl)-N-(ω-hydroxyethylpolyoxyethylene)amine;
N,N-dioctadecyl-N-(ω-hydroxyethylpolyoxyethylene)amine;

aliphatic diamines added with alkylene oxides, for example, those represented by the following formula:

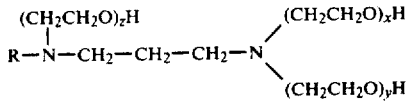

wherein, R denotes an aliphatic chain, and x, y and z stand individually for an integer; and N-(ω-hydroxyalkylpolyoxyalkylene) derivatives of aliphatic amides, for example those represented by the following formula:

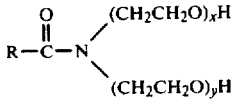

wherein R represents an aliphatic chain, and x and y denote individually an integer.

(2) Alkanol amines containing a secondary amino group:

N,N-di(2-hydroxyethyl)amine;
N,N-di(2-hydroxypropyl)amine;
N,N-di(hydroxybutyl)amine;
N-methyl-N-(2-hydroxyethyl)amine;
N-butyl-N-(2-hydroxyethyl)amine;
N-dodecyl-N-(2-hydroxyethyl)amine;
N-phenyl-N-(2-hydroxypropyl)amine;
N-acetyl-N-(2-hydroxyethyl)amine;
N-acetyl-N-(2-hydroxypropyl)amine;
N-(2-hydroxyethyl)piperazine; and
N-(2-hydroxypropyl)piperazine.

(3) Alkanol amines containing a primary amino group:

N-(2-hydroxyethyl)amine;
N-(2-hydroxypropyl)amine;
N-(hydroxybutyl)amine;
N-(1,3-dihydroxy-2-methylpropyl-2)amine;
N-(2,3-dihydroxypropyl)amine;
N-(2,3-dihydroxypropyl-2)amine;
N-(1,3-dihydroxy-2-butyl)amine;
N-(1-aminomethyl-2-hydroxyethyl)amine; and
N-(2-hydroxy-3-aminopropyl)amine.

It is desirous that these alkanol amines have a high boiling point, preferably a boiling point of at least 200° C., because they are required to stay stably as stabilizers for a methine-type dyestuff represented by the general formula (I) on a base web sheet of a recording medium such as pressure sensitive recording paper and to exhibit its stabilization effect over a long period of time.

In view of the quality of pressure sensitive recording sheets, among the above alkanol amines, those containing a tertiary amino group are especially preferred.

(B) Metal ion sequestering agents

A metal ion sequestering agent is combined with multi-valent metal ions present in a system in which microencapsulation is carried out, the dyestuff layer of a pressure sensitive recording sheet or the microscopic capsule layer of a pressure sensitive recording sheet to form a stable chelate compound, thereby effectively inhibiting any inconvenient coloration of the methine-type dyestuff even in the presence of such multi-valent metal ions.

As examples of such a metal ion sequestering agent, there may be mentioned:

water-soluble organic metal ion sequestering agents such as ethylenediamine tetraacetic acid, N-hydroxyethyl-ethylenediamine-N,N',N'-triacetic acid, diethylene triamine pentaacetic acid, triethylene tetramine pentaacetic acid, nitrilotriacetic acid, N-hydroxyethyliminodiacetic acid, diethanol glycine, ethylenediamine-N,N'-diacetic acid, glycoletherdiamine tetraacetic acid, 1,3-diaminopropan-2-ol-tetraacetic acid, tartaric acid, citric acid, gluconic acid and saccharic acid, alkali metal salts and polyacrylates thereof, and metal salts of lignin sulfonic acid; metal ion sequestering agents soluble in dyestuff solvents including Schiff bases such as N,N'-disalicylidene ethylenediamine, 1,3-diketones such as trifluoroacetylacetone, thenoyltrifluoroacetone and pivaloylacetylacetone, higher amide derivatives of ethylenediamine tetraacetic acid; and polyphosphates such as sodium tripolyphosphate, sodium polymetaphosphate, sodium pyrophosphate and sodium dihydrogenpyrophosphate. Needless to say, the metal ion sequestering agent shall not be limited to the above specific examples.

Among such metal ion sequestering agents, water-soluble organic metal ion sequestering agents and polyphosphates are preferred. The former metal ion sequestering agents are particularly preferred.

The above alkanol amine and metal ion sequestering agent are coated together with a suspension containing the methine-type dyestuff or microscopic capsules on a base web sheet such as paper and retained there so as to stabilize the methine-type dyestuff and to avoid the inconvenient coloration of a pressure sensitive recording sheet. Thus, the metal ion sequestering agent is present in the methine-type dyestuff-containing layer which is applied on a surface of a pressure sensitive recording sheet.

Accordingly, these (1) alkanol amine, (2) metal ion sequestering agent or (3) alkanol amine and metal ion sequestering agent are required to remain stably in the layer of microscopic capsules containing the dyestuff, which layer is formed on the back surface of a CB-sheet. Thus, it may be caused to present together with the dyestuff on the base web sheet in accordance with either one of various methods, including (A) adding the metal ion sequestering agent to the dyestuff at the microencapsulation step; (B) adding it to a suspension of microscopic capsules after the microencapsulation has been completed; (C) adding it to a coating suspension of microscopic capsules, in which suspension the microscopic capsules are mixed with stilts, adhesive, etc.; (D) applying a layer of the metal ion sequestering agent as an undercoat or overcoat on a layer of the coating suspension; and (E) incorporating it in base web sheets upon preparing the sheets. In view of the effectiveness of coloration inhibition and from economical standpoint, the metal ion sequestering agent is generally added by either one of methods (A), (B) and (C) so that it is retained in the layer of microscopic capsules on a pressure sensitive recording sheet. When both alkanol amine and metal ion sequestering agent are added, they are added at the same step or at different steps.

In the present invention, the alkanol amine may be employed in an amount of 10–10,000 parts by weight, preferably, 20–2,000 parts by weight per 100 parts by weight of the methine-type dyestuff. Below 10 parts by weight, the alkanol amine may not be able to provide sufficiently its effect to improve the stability of the methine-type dyestuff against oxidation during its storage. However, when used beyond 10,000 parts by weight, it adversely affects the color-producing ability of pressure sensitive recording paper. Accordingly, it is not preferable to use the alkanol amine in any amounts outside the above range. On the other hand, the metal ion sequestering agent may be used in a proportion of 0.1–1,000 parts by weight per 100 parts by weight of the methine-type dyestuff employed. It is generally sufficient if it is added in an amount of 100 parts by weight or less per 100 parts by weight of the methine-type dyestuff.

Furthermore, an ultraviolet ray absorbent may be used in pressure sensitive recording units of this invention if needed. Exemplary ultraviolet ray absorbents include benzotriazole compounds such as 2-(2'-hydroxy-5'-methylphenyl)benzotrizole, 2-(2'-hydroxy-3'-tertiary-butyl-5'-methylphenyl)-5-chlorobenzotriazole; benzophenone compounds such as 2,4-dihydroxybenzophenone, 2-hydroxy-4-methoxybenzophenone, and 2,2'-dihydroxy-4,4'-dimethoxybenzophenone; phenylsalicylate compounds such as phenylsalicylate, p-tertiary-octylphenylsalicylate, and p-tertiary-butylphenylsalicylate; substituted acrylonitrile derivatives such as ethyl 2-cyano-3,3-diphenylacrylate, and 2-cyano-3,3-diphenyl-2-ethylhexyl acrylate; and piperidine derivatives such as 4-benzoyloxy-2,2,6,6-tetramethylpiperidine. Many of these ultraviolet ray absorbents are oil-soluble and are thus used by dissolving same in a hydrophobic solvent together with a dyestuff. The ultraviolet ray absorbent may be added into the water phase of a microscopic capsule suspension either prior to or subsequent to the formation of microscopic capsules. It is then coated on pressure sensitive recording sheets.

When using the methine-type dyestuff in a microencapsulated form in accordance with this invention, various known natural or synthetic resin may be used as capsule walls. More specifically, the methine-type dyestuff is first dissolved in one of various hydrophobic solvents having a high boiling point and the thus-prepared solution is then microencapsulated in accordance with either one of the following microencapsulation methods:

(1) Coacervation method:

A wide variety of coarcervation microencapsulation methods are known, led by complex coarcervation method which makes use of the electric interaction between a polycationic colloid such as gelatin and a polyanionic colloid such as gum arabic, carboxymethyl cellulose, or methylvinylether maleic anhydride.

(2) Interfacial polymerization method:

Microscopic capsules having capsule walls made of a synthetic resin are prepared by causing different polymerization components to present respectively in water and a dyestuff-containing solution dispersed in the water and allowing a polymerization or condensation to occur at the boundaries between the water and dyestuff-containing solution. As a representative example, there are microscopic capsules having polyamide capsule walls which are formed at boundaries between a solution containing both dyestuff and terephthalic chloride and an aqueous solution of a polyamine. This interfacial polymerization method is also applied to prepare microscopic capsules having capsule walls which are made of an unsaturated polyester, polyureaurethane, epoxy, silicone or copolymer of an unsaturated dicarboxylic acid and styrene.

(3) In-situ polymerization method:

Polymerization conditions are selected so as to cause a capsule wall formation reaction to occur only on the surfaces of droplets of a dyestuff-containing solution while obtaining capsule wall-forming materials from either water phase or the dyestuff-containing solution only. Resulting polymer is used as microscopic capsule walls as is. As a specific example, urea and formaldehye are in advance dissolved in water. The aqueous solution is then subjected to a pH adjustment in the presence of an anionic polymer. Upon raising the temperature of the thus-pH adjusted solution, capsule walls are formed with urea-formaldehyde resin on the surfaces of droplets of the dyestuff-containing solution. Besides, polystyrene, melamine and melamine-polyurea capsule walls are also prepared by the in-situ polymerization method.

The methine-type dyestuff is dissolved in various hydrophobic solvents and then microencapsulated to dyestuff-containing microscopic capsule suspensions in accordance with the above-described various microencapsulation methods. As solvents for dissolving the methine-type dyestuffs therein, there may be mentioned a wide variety of nonpolar hydrocarbonaceous solvents having a high boiling point which are commonly used as solvents for pressure sensitive recording dyestuffs, such as, (1) alkylnaphthalenes: for example, methylnaphthalene, propylnaphthalene, butylnaphthalene, methyl-isopropylnaphthalene and dimethylnaphthalne; (2) diarylalkanes: for example, phenyl-xylylethane, 1,1-di-p-toluylethane, octadecyldiphenylmethane and phenyl-xylylpropane; (3) alkylpolyphenyls: for example, isopropylbiphenyl, diisopropylbiphenyl, hexylbiphenyl and 4-isopropyl-o-terphenyl; (4) hydrogenated terphenyls: for example, partially hydrogenated terphenyls; (5) triaryldimethanes: for example, dibenzyltoluene; (6) alkylbenzenes; (7) benzylnaphthalenes; (8) arylindanes; and (9) hydrocarbons originated from mineral oil, which are aliphatic hydrocarbons and naphthene-type hydrocarbons, such as kerosene. Besides the above solvents, various hydrophobic polar solvents having a high boiling point may also be used. In pressure sensitive recording papers relying upon a conventional acid-base color-producing system, particularly, pressure sensitive recording papers using an organic, acidic color-developing agent, oxygen-containing polar solvents could not be used as solvent for phthalide or fluorene dyestuffs since such dyestuffs do not show their color-producing ability at all or show extremely low color-producing ability upon contact with such a color-developing agent or developed images tend to vanish upon contact with such polar solvents, thereby rendering themselves totally unsuitable for practical use. However, the pressure sensitive recording sheet of a pressure sensitive recording unit according to this invention can promptly produce deep color images upon contact with an acidic color-developing agent regardless the polarity of the dyestuff solvent. As a result, it has become possible to select not only a nonpolar hydrocarbonaceous solvent of a high boiling point mentioned above but also a hydrophobic solvent of desired polarity in view of its solubility to the methine-type dyestuff of the general formula (I) and organic oxidizing color-developing agent.

Specific examples of polar solvents, which may be used as dyestuff solvents, include the following high b.p. compounds: (1) diphenylether derivatives: for example, isopropyldiphenylether, diisopropyldiphenylether, tert.-butyldiphenylether, dodecyldiphenylether and tetradecyldiphenylether; (2) aromatic esters of dibasic acids: for example, dioctylphthalate, diheptylphthalate, dibutylphthalate, didecylphthalate, didodecylphthalate, butylbenzylphthalate, dicyclohexylphthalate and diphenylphthalate; (3) aliphatic esters of dibasic acids: for example, dioctyladipate, diisodecyladipate, n-octyl-n-decyladipate, dinonyladipate, dioctylsuccinate, diactylglutanate, ditridecylglutanate, dioctylsebacate, dioctylazelate, dioctylmaleate and dioctylfumarate; (4) aromatic esters of tribasic acids: for example, tri-2-ethylhexyl trimellitate, tri-n-butyl trimellitate, tri-n-octyl trimellitate and toluyldecyl trimellitate; (5) aromatic esters, for example, benzoates; (6) monobasic esters of fatty acids, for example, butyloleate; (7) esters of hydroxy-fatty acids, for example, acetyltributylcitrate, acetyl-trioctylcitrate and methylacetylricinoleate; (8) liquid natural oils, for example, nondrying oils such as olive oil, castor oil and cotton seed oil; (9) liquid esters of phosphoric acids, for example, tricresylphosphate, triphenylphosphate and trioctylphosphate; and (10) liquid esters of silicic acids.

In the novel pressure sensitive recording unit according to this invention, the methine-type dyestuff and organic oxidizing compound are supported on a base web sheet in such a way that they are brought into direct contact by writing, marking or typing pressures to develop a color.

Therefore, the pressure sensitive recording units according to this invention may include the following embodiments: (1) a pressure sensitive recording unit comprising a combination of two sheets, one carrying a layer containing a methine-type dyestuff (generally, dyestuff-containing microscopic capsules as mentioned above; the term "methine-type dyestuff" will have this meaning in this paragraph) and the other supporting a layer containing an organic oxidizing compound; (2) a pressure sensitive recording unit comprising a combination of at least two sheets, each carrying on the front and back surfaces thereof a layer containing a methine-type dyestuff and another layer containing an oxidizing compound respectively and the unit (1) mentioned above; (3) a pressure sensitive recording unit comprising a base web sheet which supports on a common surface thereof a layer containing a methine-type dyestuff and another layer containing an organic oxidizing compound superposed with the former layer or a single layer containing both methine-type dyestuff and organic oxidizing compound in such a way that they do not contact with each other directly under normal conditions; and (4) a unit obtained by suitably combining units (1), (2) and/or (3). In each of these units, an alkanol amine and/or metal ion sequestering agent are contained in the layer containing the methine-type dyestuff.

Pressure sensitive recording sheets of the pressure sensitive recording unit according to this invention may generally be prepared in much the same way as the current pressure sensitive recording system, namely, by the following methods:

(A) CB-sheets:

To a suspension containing microscopic capsules of a hydrophobic solvent which in turn contains a methine-type dyestuff, are first of all mixed accidental smudge-preventive stilts such as cellulose floc (pulp powder), starch particles (e.g., starch produced from a starch source such as wheat, corn, potatoes, sweat potatoes, sago, tapioca, rice, glutinous rice, glutinous corn or the like, a starch derivative such as an oxidized starch obtained by treating such starch with an oxidizing agent, esterified starch represented by acetylated starch, etherified starch or aldehydostarch, or denatured starch), talc, clay, calcium carbonate and/or beads made of polystyrene resin; an aqueous solution of a water-soluble polymer as an adhesive (polyvinylalcohol, soluble starch such as oxidized starch, carboxymethyl cellulose, casein or the like) to form an aqueous coating suspension. Then, the aqueous coating suspension is applied onto a base web sheet such as paper by means of a coater and dried to provide a back-coated topsheet, i.e., CB-sheet.

(B) CF-sheets:

Either one of the following known methods can be employed for the preparation of CF-sheets:

(1) An aqueous suspension of an organic oxidizing compound is coated as an aqueous coating composition on a base wet sheet by using a coater;

(2) A color-developing agent is incorporated in a base web sheet during the paper-making step; and (3) An ink composition comprising an organic solvent and an organic oxidizing compound dissolved or suspended therein (hereinafter referred to as "color-developing ink") is coated thoroughly onto a surface of a base web sheet by a coater or partially (i.e., spot) printed on the surface of the base web sheet.

Generally, it is preferred to coat an aqueous coating composition—method (1) or to coat a color-developing ink—method (3). The aqueous coating composition used in method (1) is generally prepared by mixing an aqueous suspension of an organic oxidizing compound and, if necessary, an aqueous suspension of an adsorptive inorganic compound, in order to improve the characteristics of the coated surface of a pressure sensitive recording sheet, with various additives such as (i) an inorganic or organic pigment such as kaoline clay, calcium carbonate, colloidal silica, or polystyrene dispersion; (ii) a dispersant for pigment, such as a polyphosphate or polyacrylate; (iii) an adhesive such as an aqueous solution of starch or denatured starch, synthetic or natural rubber latex emulsion, or polyvinylacetate emulsion; and (iv) others including a fluorescent brightening agent, defoaming agent, viscosity regulator, dusting inhibitor, slime-controlling agent, lubricating agent and waterproofing agent so that it has a viscosity and rheology suitable for the coating method thereof.

The color-developing ink used in method (3) may be prepared in accordance with any formulation method commonly employed in the technical field of ink. Namely, the color-developing ink may be prepared by dissolving a color-developing agent and, besides an adsorptive inorganic compound which may be incorporated if necessary, kaolin, zinc hydroxide, aluminum hydroxide or calcium carbonate as a pigment in either one of various organic solvents, for example, ethanol, isopropanol, acetone, methylethyl ketone, ethylacetate, methylacetate, methylcellosolve, ethylcellosolve, toluene, or xylene. Thereafter, nitrocellulose, acetylcellulose, ethylcellulose, methylcellulose, polyvinylchloride, polyvinylacetate or polyvinylbutylal as a binder and various aids such as dispersant, blocking inhibitor and plasticizer are suitably added to obtain an oil-base color-developing ink.

The aqueous coating composition or color-developing ink prepared as described above is then coated or printed on a base wet sheet by gravure printing or flexographic printing method to provide a front-coated sensitized undersheet for pressure sensitive recording (i.e., CF-sheet).

(C) SC-sheets:

An SC-Sheet is prepared by coating on the same surface of a base web sheet a layer of microscopic capsules enclosing a solution which contains a methine-type dyestuff and another layer containing an organic oxidizing compound.

These layers may be applied in accordance with either one of known methods, namely, for instance, by (1) coating in advance a layer of dyestuff-containing microscopic capsule suspension and then applying over the layer another layer containing an organic oxidizing compound and, preferably, an adsorptive inorganic compound or (2) coating onto a base web sheet a coating composition which has been prepared in advance by mixing a dyestuff-containing microscopic capsule suspension, organic oxidixing compound and, preferably, adsorptive inorganic compound.

The invention is further explained specifically with reference to the following examples and comparatory examples, in which dyestuff-containing microscopic capsule suspension, back-coated topsheets for pressure sensitive papers (CB-sheets) and aqueous suspensions of color-developing agents were prepared respectively in accordance with the following methods. The evaluation of the quality and/or performance of prepared pressure sensitive recording papers was effected by the following method.

(I) Preparation of dyestuff-containing microscopic capsule suspensions (a) Ten grams of acid-treated gelatin (I.E.P.: pH 8.6) was soaked for one hour in 90 g of water and dissolved at 55° C., to which 69 g of a hydrophobic solvent having a high boiling point and containing 3% by weight of a dyestuff dissolved therein was added. The resulting mixture was emulsified by a high-speed emulsifier while maintaining its temperature at 55° C. until the mean particle size was reduced to 5 μm. Thereafter, 100 g of a 5% aqueous solution of carboxymethyl cellulose (average molecular weight: 230, etherification degree: 0.75) was added, followed by a further dropwise addition of a 10% aqueous solution of acetic acid to drop the pH of the mixture to pH 4.1. Then, 215 g of warm water of 55° C. was added. While stirring the system slowly, the system was cooled externally. When the mixture was cooled to 10° C., 20 g of a 50% aqueous solution of glutaric aldehyde was added. The mixture was stirred for 20 minutes, followed by a dropwise slow addition of a 10% aqueous solution of sodium hydroxide in the course of 30 minutes to raise the pH of the system to pH 10.5. Then, the mixture was heated to 40° C. to harden the capsule walls, followed by an aging for 2 days at room temperature, thereby completing the hardening of the capsule walls. Finally, 8 g of an alkanol amine was added and mixed to give a dyestuff-containing microscopic capsule suspension.

(b) After mixing 12.6 g of a hydrophobic solvent containing 4 parts by weight of a dyestuff dissolved therein with 25 g of a 6% aqueous solution of acid-treated gelatin containing 0.1 g of disodium salt of N-hydroxyethylethylene-diamine-triacetic acid, 50 g of a 1% aqueous solution of carboxylmethyl cellulose (average polymerization degree: 160, etherification degree: 0.70) was mixed with the mixture while continuing the stirring. Then, the resulting mixture was diluted by the addition of 30 g of warm water, followed by an addition of a 10% solution of acetic acid to adjust its pH to 4.3, thereby inducing coacervation. While continuing the stirring, the temperature of the mixture was dropped to 8° C. so as to gel the coarcervate capsules walls. After combining 1.75 g of a 37% solution of formaldehyde with the mixture, its pH was adjusted to 10.5 by dropping slowly a 10% aqueous solution of caustic soda, followed by raising the temperature of the mixture to 40° C. to harden the coarcervate capsule walls, thereby preparing a microscopic capsule suspension.

(c) To 400 g of water, were added and dissolved 100 g of a 10% aqueous solution of an ethylene-maleic anhydride copolymer having a molecular weight of 75,000-90,000 (trade name: EMA-31), product of Monsanto, Mo., U.S.A.), 1.0 g (as a solid portion) of a metal ion sequestering agent, 10 g of urea and 1 g of resorcin. Then, the pH of the mixture was adjusted to 3.5 by adding dropwise a 10% aqueous solution of sodium hydroxide, followed by a further addition of 170 g of a hydrophobic solvent having a high boiling point in which 3% by weight of a dyestuff is dissolved. Then, the resulting mixture was emulsified by means of a high speed emulsifier to prepare an o/w-emulsion having a mean particle size of 7 μm. Then, 25 ml of a 37% formaldehyde solution was added and the resulting system was stirred at 55° C. for 5 hours to induce the formation of capsule walls through the polycondensation of urea, resorcin and formaldehyde. After that, the pH of the mixture was raised to 9.0 by adding thereto a 10% aqueous solution of sodium hydroxide and the resultant system was agitated for further one hour and allowed to cool down. Then, 20 g of an alkanolamine was added to obtain a microscopic capsule suspension.

(d) To 85 g of a 10% aqueous solution of a copolymer of ethylene and maleic anhydride (trade name: EMA-31, product of Monsanto, Mo., U.S.A.), which contained 2.0 g of ethylenediaminetetraacetic acid dissolved therein, were added and dissolved 180 g of water, 10 g of urea and 1 g of resorcin, followed by the addition of a 10% aqueous solution of caustic soda to adjust its pH to 3.3. Then, 170 g of an hydrophobic solvent which contained a dyestuff in an amount of 4% by weight of the solvent was mixed to the above aqueous solution. Then, the resulting aqueous solution was emulsified by agitating same at a high speed in a homomixer. After incorporating 26 g of a 37% aqueous solution of formaldehyde, the thus-obtained mixture was subjected to polymerizatin while stirring same for 3 hours at 55° C., resulting in the formation of microscopic capsule walls. The mixture was then allowed to cool down, thereby providing a suspension containing microscopic capsules whose walls were made of urea-formaldehyde resin.

(e) To a mixture of 67 g of a hydrophobic solvent containing 3.5 parts by weight of a dyestuff and 25 g of terephthalic dichloride, was added 250 g of water containing 4 g of polyvinylalcohol. The resulting mixture was emulsified, followed by a dropwise gradual addition of a mixture of 0.5 g of ethylenediamine, 10 g of hexamethylenediamine, 10 g of caustic soda and 75 g of water so as to conduct a polyamide condensation reaction between terephthalic dichloride and the amines at interfaces therebetween, thereby obtaining a microscopic capsule suspension.

(B) Preparation of pressure sensitive recording paper (CB-paper):

Per 100 parts of each of the microscopic capsule suspensions (the parts being based on its solid portion only) prepared by methods (a)-(e) in the above item (A), were added 20 parts of cellulose powder and 25 parts of a 20% aqueous solution of oxidized starch. The resulting mixture was coated on a high grade paper by a bar coater in such an amount that the coating was 4.5 g/m$^2$ in a dry state, thereby obtaining a CB-sheet.

(C) Preparation of aqueous suspension of color-developing agent:

In a sand grinding mill, 40 parts of an organic oxidizing compound, 4 parts of a 25% aqueous solution of the sodium salt of a polycondensation product between diisobutylene and maleic anhydride as a dispersant, and 56 parts of water were subjected to wet communition to obtain an aqueous suspension containing particles of 2-3 μm in mean diameter.

(II) Measurement methods of various abilities and properties as pressure sensitive recording paper (A) Color-producing ability:

In each of examples and comparative examples, the CB-sheet and CF-sheet were superposed with their coated surfaces confronting each other. The measurement of the density of each of produced colors was carried out by determining its reflectivity with a TSS-type Hunter colorimeter (manufactured and sold by Toyo Seiki Seisaku-sho, Ltd., Tokyo, Japan).

The above measurement was conducted 30 seconds after producing a color by a typewriter (initial density of a developed color) and also 72 hours later (arrival density of the developed color). Using reflectivities $I_0$, $I_1$ and $I_2$ obtained respectively before producing the color, 30 seconds after producing the color and 72 hours after producing the color, the percentage initial color production ($J_1$) and percentage arrival color production ($J_2$) were calculated by the following equations:

$$\text{Percentage initial color production}(J_1) = I_0 - I_1 \times 100(\%)$$

$$\text{Percentage arrival color production}(J_2) = I_0 - I_1 \times 100(\%)$$

The greater the percentage initial color production and percentage arrival color production and the smaller the difference between both of the productions, the faster the color-producing speed and the deeper the thus-produced color are indicated.

By the way, the storage of pressure sensitive recording papers and their color production tests were conducted respectively in accordance with the pretreatment procedure of paper to be tested defined in JIS(Japan Industrial Standard) P-8111-1976 and in an air-conditioned room at 20° C. and 65% R.H.

(B) Color fastness of produced images against light:

After the lapse of 72 hours since the production of a color, each CF-sheet was exposed to actual sunlight and the density of its color image was determined by the Hunter colorimeter. The measurement result was then converted to a percentage color production after exposure for showing it in Table 1 and Table 2, which will appear after Comparative Example 5. The higher the percentage color production after exposure, the lesser the vanishment of the produced color image due to exposure to light.

(C) Resistance of produced color images to plasticizer:

The following testing method was employed to obtain a rough indication showing the degree of color vanishment due to various phthalates which are used extensively as plasticizers for polyvinylchloride resin.

The color image-bearing surface of a CF-sheet was bought into close contact with a polyvinylchloride sheet of a commercially available pocket file which contained dioctyl phthalate as a plasticizer and kept for 24 hours in a thermostat maintained at 60° C. while applying thereon a load of 1 kg per 100 $cm^2$. Then the polyvinylchloride sheet was peeled off and the density of the color image was compared with that of the same color image before the test. The test was conducted on each CF-sheet which had been stored in a dark place for 2 weeks after the production of its color image. The lesser the fading of the produced color after the test, the greater the resistance to polar solvents such as plasticizers. Thus, it is preferable that no reduction of the density of produced color images is observed after the above test.

(D) Resistance of produced color images to heat:

In many acid-base color-producing systems, the density of their color images depends on temperature, in other words, lowers as the temperature goes higher. Accordingly, they have a problem in their storage. In order to test the stability of a produced color image during its storage at high temperatures, each CF-sheet bearing a produced color image was kept for 8 hours in a thermostat maintained at 100° C. Then, the CF-sheet was cooled down to room temperature to determine the density of the color image after the test. The density of the color image was also measured before the test. Their difference was calculated.

(E) Resistance of produced color images to water:

Each CF-paper, which bore thereon a color image produced by a typewriter, was kept for 2 hours in water. Its density and hue changes were visually observed.

(F) Coloration of CF-sheets to yellow:

Each CF-sheet, obtained by coating a color-developing agent thereon, was exposed under the following conditions. The degree of yellow coloration on the coated surface of the CF-sheet was given as a reflectivity using a Hunter colorimeter (a blue filter was used).

The smaller the reflectivity, the more the coated surface became yellowish.

(F-1) Yellow coloration due to light (exposed to light):

Each CF-sheet, which had not been subjected to any color production, was exposed for 10 hours to sunlight.

(F-2) yellow coloration in oxidizing atmosphere (exposed to $NO_x$):

When a pressure sensitive recording paper is stored for a long period of time, a yellowing phenomenon is observed due to, presumably, the oxidation of its color-developing agent by gases present in the air. To investigate the degree of such yellow coloration, each CF-sheet was exposed for 60 minutes to an atmosphere of $No_x$ gas and its reflectivity was measured both before and after the test, in accordance with JIS-L-1055-1961 (Testing method of color fastness of dyed articles and dyestuffs against oxidized nitrogen gases).

The higher the reflectivity after the test and the smaller the difference in reflectivity between before and after the test, the lesser the yellow coloration after the test.

(G) Coloration of microscopic capsule-bearing surfaces of CB-sheet:

(G-1) Degree of coloration of coated surfaces of CB-sheets:

The degree of coloration of the coated surface of each of back-coated topsheets (CB-sheets) respectively coated with aqueous coating compositions containing the dyestuff-containing microscopic capsule suspensions prepared in the examples was measured using a Hunter colorimeter (equipped with an amber filter).

The greater the measurement value, the whiter the CB-sheet. A measurement value of 80% or higher indicates substantially a white color to eyes.

(G-2) Degree of coloration of coated surfaces of CB-sheets after exposure to light:

Subsequent to exposing the coated surface of each CB-sheet to direct sunlight for 20 minutes, the degree of its coloration was measured by means of a Hunter colorimeter. The degree of coloration was represented in terms of reflectivity and hue of the coated surface.

EXAMPLE 1

Using, as a dyestuff, 3,3'-dimethyl-4,4'-diethylamino-4'-dimethylaminotriphenylmethane (m.p. 68°-70° C.) and, as a dyestuff solvent, diisopropylnaphthalene, a microscopic capsule suspension was prepared in accordance with the dyestuff-containing microscopic capsule production method (b). A CB-sheet was then prepared. Then, using an organic oxidizing compound (hereinafter called simply "color-developing agent"), 2,3,5,6-tetrakis-ethoxycarbonyl-1,4-benzoquinone (m.p. 149°-150° C.), an aqueous coating composition which had a composition given below and contained 40% of solid portion was prepared.

| Composition (Solid Portion) | |
|---|---|
| Kaolin | 85 parts by weight |
| Calcium carbonate | 15 parts by weight |
| Color-developing agent | 4 parts by weight (used as aqueous dispersion) |
| Styrene-butadiene latex | 6 parts by weight (used as aqueous dispersion) |
| Oxidized starch | 10 parts by weight (used as aqueous solution) |

The aqueous coating composition was then applied by a Meyer-bar on a high grade paper in such an amount that the coating was 6.0 g/$m^2$ in a dry state, thereby preparing a CF-sheet.

Various ability and/or property evaluations were conducted on a pressure sensitive recording paper obtained by combining the above CB-sheet and CF-sheet together. The pressure sensitive recording paper promptly produced a color by pressures. Thus, it gave a deep purple image having extremely great color fastness. The CF-sheet was not turned to yellow even after its exposure to light and the oxidizing atmosphere.

EXAMPLES 2-9

As CF-sheets, those prepared in Example 1 were employed. As dyestuffs and dyestuff solvents, the following were used respectively. The CF-sheets were combined with CB-sheets which were also prepared by the same method as that employed in Example 1 to complete pressure sensitive recording papers, on which various tests, similar to those effected in Example 1, were conducted.

| Ex. # | Dyestuff (m.p. °C.) | Dyestuff solvent | Hue produced |
|---|---|---|---|
| 2 | 4,4'-bis-dimethylamino-4''-dimethylamino-3''-methoxytriphenylmethane (142-144) | diisopropyl naphthalene | blue |
| 3 | bis(4-dimethylamino-phenyl)-4'-methoxy-naphthyl-1-methane (151-153) | phenyl-xylylethane | dark blue |
| 4 | 4,4'-bis-dimethylamino-3''-methyl-4''-methoxy-triphenylmethane (112-114) | phenyl-xylylethane | green |
| 5 | 4,4'-bis-dimethylamino-3''-tert. butyl-4''-methoxytriphenylmethane (146-148) | dodecyl-phenyl ether | dark green |
| 6 | 4,4'-dimethoxy-3''-methyl-4''-methylamino-triphenylmethane 73.5-75.5) | dodecyl-phenyl ether | vermilion |
| 7 | bis-(1-ethyl-2-methyl-indol-3-yl)-2',4'-dimethoxyphenylmethane (138-140) | dioctyl phthalate | red |
| 8 | 3,6-bisdiethylamino-9-phenylxanthen (115-117) | butyl-naphthalene | reddish purple |
| 9 | 4,4'-bis-dimethylamino-4''-N—morpholinotri-phenylmethane (203-205) | equiweight mixture of phenylxylyl ethane and dibutyl phthalate | blue |

EXAMPLE 10

4,4',4''-Tris-diethylamino-triphenylmethane (m.p. 93.5°-94.5° C.) and isopropyldiphenyl were used respectively as a dyestuff and solvent therefor. They were microencapsulated in accordance with the dyestuff microencapsulation method (d). A CB-sheet was thereafter prepared.

Using 2,5-diethoxycarbonyl-3,6-dichloro-1,4-benzoquinone (m.p. 197°-198° C.) as a color-developing agent, an aqueous coating composition which had a composition given below and contained 40% of solid portion was prepared.

| Composition (Solid Portion) | |
|---|---|
| Kaolin | 85 parts by weight |
| Active zinc flower* | 15 parts by weight |
| Styrene-butadiene latex | 8 parts by weight (used as aqueous dispersion) |
| Color developing agent | 5 parts by weight (used as aqueous dispersion) |
| Oxidized starch | 8 parts by weight (used as aqueous solution) |

*a low temperature calcine of basic zinc carbonate (specific surface area: 30 $m^2/g$; trade name: AZO, product of Seido Chemical Industry Co., Ltd., Tokyo, Japan).

The coating composition was then applied by an air knife on a base web sheet for pressure sensitive recording in such an amount that the coating was 5.5 $g/m^2$ in a dry state, and dried to give a CF-sheet.

Various ability and/or property evaluations were conducted on a pressure sensitive recording paper obtained by combining the above CB-sheet and CF-sheet together. The resulting pressure sensitive recording paper produced promptly a color upon application of pressures thereto. Thus, it gave a deep royal purple image having extremely great color fastness. The CF-sheet was not turned to yellow through its exposure to light and the oxidizing atmosphere.

EXAMPLES 11-16

As CF-sheets, those prepared in Example 10 were employed. As dyestuffs and dyestuff solvents, the following compounds were used respectively. The CF-sheets were combined with CB-sheets which were also prepared by the same method as that employed in Example 10 to complete pressure sensitive recording papers, on which various tests were effected.

| Ex # | Dyestuff (m.p. °C.) | Dyestuff solvent | Hue produced |
|---|---|---|---|
| 11 | 3,3'-dimethyl-4,4'-di-methylamino-3''-methyl-4''-ethoxytriphenyl-methane (109-111) | methyl-isopropyl naphthalene | dark green |
| 12 | 4,4'-bis(N—p-chloro-benzene-N—methylamino)-4''-dimethylaminotri-phenylmethane (88-90) | methyl-isopropyl naphthalene | blue |
| 13 | 4,4'-bis-dimethylamino-4''-(N—methyl-N—phenyl-amino)-triphenylmethane (180-182) | phenyl-xylyl ethane | blue |
| 14 | 4-dimethylamino-triphenylmethane (132.5-134.5) | phenyl-xylyl ethane | yellow |
| 15 | bis(4'-dimethylamino-phenyl)-naphthyl-2-methane (125-127) | phenyl-xylyl ethane | yellowish green |
| 16 | bis(4-dimethylamino-phenyl)--styryl-methane (106-108) | phenyl-xylyl ethane | green |

EXAMPLE 17

4,4'-Bis-dimethylamino-4''-N-methyl-N-benzylaminotriphenylmethane (m.p. 129°-130° C.) and a mixture of dodecyl diphenyl ether and kerosene in a weight ratio of 80/20 were used respectively as a dyestuff and its solvent. They were microencapsulated in accordance with the dyestuff microencapsulation method (e) and then applied to form a CB-sheet.

Next, using 2,5-diethoxycarbonyl-3,6-dibromo-1,4-benzoquinone (m.p. 225°-227° C.) as a color-developing agent, an aqueous coating composition which had a composition given below and contained 40% of solid portion was prepared. The coating composition was then applied by a doctor blade on a base web sheet for pressure sensitive recording paper in such an amount that the coating was 7 $g/m^2$ in a dry state, and dried to give a CF-sheet.

| Composition (Solid Portion) | |
|---|---|
| Kaolin | 80 parts by weight |
| Calcium carbonate | 20 parts by weight |
| Modified titanium oxide* | 20 parts by weight |
| Color-developing agent | 5 parts by weight (used as aqueous dispersion) |
| Oxidized starch | 12 parts by weight (used as aqueous solution) |

*Modified titanium oxide:
White fine powder obtained by mixing water containing 0.35 g of caustic potash with 400 g of metatitanic acid slurry (140 g as $TiO_2$, product of Fuji Titanium Industry Co., Ltd., Osaka, Japan)

Various ability and/or property evaluations were made on a pressure sensitive recording paper obtained by combining the above CB-sheet and CF-sheet together. The resulting pressure sensitive recording paper produced promptly a color by pressures, thereby giving a deep blue image having extremely great color fastness.

EXAMPLE 18

4,4',4'-Tris-dimethylamino-triphenylmethane (m.p. 172°-173° C.) and myristyl diphenyl ether were employed respectively as a dyestuff and its solvent. They were microencapsulated in accordance with the dyestuff microencapsulation method (d) to form a microscopic capsule suspension. Onto a surface of a pressure sensitive recording paper on which surface the above microscopic capsule suspension had been coated, an aqueous coating composition which had a composition given below and contained 30% of solid portion was applied by a bar coater in such an amount that the coating was 6 g/m$^2$ in a dry state. Upon drying the thus-coated paper, was prepared a pressure sensitive recording paper which by itself would produce a blue color by pressures.

| Composition (Solid Portion) | |
|---|---|
| Kaolin | 80 parts by weight |
| Modified titanium oxide* | 20 parts by weight |
| Color-developing agent** | 3 parts by weight (used as aqueous dipersion) |
| Methylmethacrylic butadiene latex | 8 parts by weight (used as aqueous dipersion) |
| Oxidized starch | 6 parts by weight (used as aqueous solution) |

*Modified titanium oxide:
White powder obtained by mixing thoroughly 300 g of metatitanic acid slurry (90 g as $TiO_2$, product of Titan Kogyo Kabushiki Kaisha, Yamaguchi, Japan) and water containing 0.2 g of caustic soda, drying same and then calcining at 700° C. for 2 hours.
**Color-developing agent:
2,2',3,3',5,5',6,6'-Octachloro-4,4'-diphenoquinone.

EXAMPLES 19, 20 AND 21

The procedure of Example 18 was followed except for using, as a dyestuff, 4,4'-bis-dimethylamino-3''-methyl-4''-ethoxytriphenylmethane (m.p. 79°-81° C.), bis(1-ethyl-2-methylindol-3-yl)-4'-ethoxy-phenylmethane (m.p. 167.5°-169.5° C.) and bis(4-dimethylaminophenyl)-3-pyridylmethane (m.p. 109°-111° C.) individually, thereby producing single-sheet pressure sensitive recording papers (i.e., SC-sheets).

The SC-sheets of Examples 18 through 20 developed, promptly and with deep tone, a royal purple color (Example 18), a dark green color (Example 19), a red color (Example 20), and a green color (Example 21), respectively, by typing pressures applied by a typewriter.

EXAMPLE 22

To a solvent mixture consisting of 15 parts of nitrocellulose, 15 parts of ethanol, 30 parts of ethyl acetate and 4 parts of methylethylketone, were added as a color-developing agent 10 parts of 3,3'-diethoxycarbonyl-4,4'-diphenoquinone, 18 parts of activated alumina and 8 parts of aluminum hydroxide. The resulting mixture was thoroughly agitated in a propeller mixer to prepare a color-developing ink, which was then coated onto a high grade paper by a gravure coater in such an amount that the ink was 5 g/m$^2$ in a dry state. Upon drying the ink, a CF-sheet was obtained. When this CF-sheet was brought into contact with the CB-sheet obtained in Example 12, a blue image was produced at a fast speed.

EXAMPLE 23

3,3'-Dimethyl-4,4'-bis-ethylamino-triphenylmethane (m.p. 68°-70° C.), diisopropylnaphthalene and tris(2-hydroxyethyl)amine were used respectively as a dyestuff, its solvent and alkanol amine. They were converted to a microscopic capsule suspension in accordance with the dyestuff microencapsulation method (a) and a back-coated topsheet (CB-sheet) for pressure sensitive recording paper was prepared.

Using 2,5-di-n-hexyloxycarbonyl-3,5-dibromo-1,4-benzoquinone (m.p. 84°-86° C.) as an oxidizing quinone derivative which is a color-developing agent, an aqueous coating composition having the following composition and containing 40% of solid portion was prepared. It was then applied onto a high grade paper by a Meyer-bar in such an amount that the coating was 6.0 g/m$^2$ in a dry state, thereby obtaining a front-coated sensitized undersheet (CF-sheet).

| Composition (Solid Portion) | |
|---|---|
| Kaolin | 70 parts by weight |
| Calium carbonate | 15 parts by weight |
| Sodium tripolyphosphate | 1.5 parts by weight |
| Color-developing agent | 2 parts by weight (used as aqueous dipersion) |
| Styrene-butadiene latex | 6 parts by weight (used as aqueous dipersion) |
| Oxidized starch | 10 parts by weight (used as aqueous solution) |

On the combination of the above CB-sheet and CF-sheet as a pressure sensitive recording paper, various ability and/or property evaluation tests were made. The pressure sensitive recording paper of this example produced promptly a color by pressures, thereby giving a deep purple image having extremely great color fastness. The CF-sheet did not develop any yellowish tinge or color through its exposure to light and the oxidizing atmosphere.

EXAMPLES 24-32

As CF-sheets, those prepared in Example 23 were employed. Various microscopic capsule suspensions were prepared in accordance with the microencapsulation method (a), using the following compounds as dyestuffs, their solvents and alkanol amines. CB-sheets were prepared by using the thus-prepared microscopic capsule suspensions. Various tests were conducted on the combinations of these CB-sheets and the aforesaid CF-sheets. Developed hues are also given in the following table.

| Ex. # | Dyestuff (m.p. °C.) | Dyestuff solvent | Alkanol amine | Hue produced |
|---|---|---|---|---|
| 24 | 4,4',4''-tris(dimethylamino)-3-methoxy-triphenylmethane (142-144) | dibenzyl benzene | N—methyl-N,N—bis-(hydroxyethyl)amine | blue |
| 25 | bis(4-dimethylaminophenyl)-4'-methoxy-naphthyl-1-methane (151-153) | phenyl-xylyl ethane | tris-(2-hydroxy-propyl)amine | dark blue |

-continued

| Ex. # | Dyestuff (m.p. °C.) | Dyestuff solvent | Alkanol amine | Hue produced |
|---|---|---|---|---|
| 26 | 4,4'-bis(dimethylamino)-3'-methyl-4''-methoxytriphenylmethane (112–114) | phenylxylyl ethane | tris-(2-hydroxypropyl)amine | green |
| 27 | 4,4'-bis(dimethylamino)-3'-tert. butyl-4''-methoxytriphenylmethane (146–148) | dodecyldiphenyl ether | N—dodecyl-N,N—bis-(ω-hydroxyethylpentaxyethylene)amine | dark green |
| 28 | 4,4'-dimethoxy-3''-methyl-4''-methylamino-triphenylmethane (73.5–75.5) | acetyltributyl citrate | N—dodecyl-N,N—bis-(ω-hydroxyethylpentaxyethylene)amine | vermilion |
| 29 | bis(1'-ethyl-2'-methylindol-3'-yl)-2,4-dimethoxyphenylmethane (138–140) | dioctyl succinate | tris-(N—ω-hydroxyethylpentaoxyethylene) amine | red |
| 30 | 3,6-bis(diethylamino)-9-phenylxanthen (115–117) | dioctyl adipate | tris-(N—ω-hydroxyethylpentaoxyethylene) amine | reddish purple |
| 31 | 4,4'-bis(dimethylamino)-4''-N—morpholino-triphenylmethane (203–205) | ethyl diphenyl | tris-(N—ω-hydroxyethylpentaoxyethylene) amine | blue |
| 32 | bis(4-dimethylamino)-phenyl-4'-methoxy-β-styrylmethane (93–95) | tetraoctyl silicate | tris(N—ω-hydroxyethylpentaoxyethylene) amine | bluish green |

EXAMPLE 33

A dyestuff-containing microscopic capsule suspension was prepared in accordance with the dyestuff microencapsulation method (c) by using 4,4',4''-tris(diethylamino)triphenylmethane (m.p. 93.5°–94.5° C.), an equiweight mixture of diisopropylnaphthalene and phenylxylylethane, N-hydroxyethylmorpholine, and the trisodium salt of N-hydroxyethyl ethylenediamine triacetic acid as a dyestuff, its solvent, an alkanol amine and metal ion sequestering agent respectively. The suspension was used to prepare a CB-sheet for pressure sensitive recording paper.

Then, using 2,5-diethoxycarbonyl-3,6-di(p-tolylsulphonyl)-1,4-benzoquinone (m.p. 249°–251° C.) as a color-developing agent, an aqueous coating composition which had a composition given below and contained 25% of solid portion was prepared. It was thereafter coated on a base web sheet for pressure sensitive recording sheet by means of an air knife in such an amount that the coating was 6 g/m$^2$ in a dry state. The coating was then dried, providing a CF-sheet. Ability and/or property evaluations as pressure sensitive recording paper were made on a combination of the above CB-sheet and CF-sheet. It gave a bluish purple image. The CF-sheet did not turn to yellow in the oxidizing atmosphere.

| Composition (Solid Portion) | |
|---|---|
| Kaolin | 90 parts by weight |
| Zinc oxide | 10 parts by weight |
| Sodium metaphosphate | 1 part by weight |
| Color-developing agent | 3 parts by weight (used as aqueous dispersion) |
| Methylmethacrylate-butadiene latex | 8 parts by weight (used as aqueous dispersion) |
| Hydroxyethylated starch | 8 parts by weight (used as aqueous solution) |

EXAMPLES 34–40

CF-sheets prepared in Example 33 were employed. Using the following compounds respectively as dyestuffs, their solvents, alkanol amines and metal ion sequestering agents, dyestuff-containing microscopic capsule suspensions were prepared in accordance with the dyestuff microencapsulation method (c). The suspensions were individually applied onto base web sheets, thereby obtaining CB-sheets. They were then combined with the aforementioned CF-sheets, and subjected to various tests. Developed hues are also shown in the following table for reference.

| Ex. # | Dyestuff (m.p. °C.) | Dyestuff solvent | Alkanol amine | Metal ion sequestering agent | Hue produced |
|---|---|---|---|---|---|
| 34 | 3,3',3'-trimethyl-4,4'-dimethylamino-4''-ethoxy-triphenylmethane (109–111) | methylisopropyl naphthalene | tris(2-hydroxypropyl)amine | trisodium N—hydroxyethyl ·green ethylenediamine-triacetate | dark |
| 35 | 4,4',4''-tris(dimethylamino)triphenylmethane (172–173) | partially hydrogenated terphenyl | tris(2-hydroxypropyl)amine | trisodium N—hydroxyethyl · ethylenediamine-triacetate | bluish purple |
| 36 | 4,4'-bis(N—p-chlorobenzyl-N—methylamino)-4''-dimethylamino-triphenylmethane (88–90) | dioctyl phthalate | tris(2-hydroxypropyl)amine | pentasodium diethylene-triamine-pentaacetate | blue |
| 37 | 4,4'-bis(dimethylamino)-4''-(N—methyl-N—phenylamino)-triphenylmethane (180–182) | phenylxylyl ethane | N—acetyl-N,N—(2-hydroxypropyl)amine | pentasodium diethylene-triamine-pentaacetate | blue |
| 38 | 4-dimethylamino-triphenylmethane (132.5– | phenylxylyl ethane | N—acetyl-N,N—(2-hydroxy- | pentasodium diethylene-tri- | yellow |

-continued

| Ex. # | Dyestuff (m.p. °C.) | Dyestuff solvent | Alkanol amine | Metal ion sequestering agent | Hue produced |
|---|---|---|---|---|---|
| | 134.5) | | propyl)amine | amine-penta-acetate | |
| 39 | bis(4-dimethylamino)-naphthyl-2'-methane (125–127) | phenylxylyl ethane | N—acetyl-N,N—(2-hydroxy-propyl)amine | sodium metaphosphate | bluish green |
| 40 | bis(4-dimethylamino-phenyl)-β-styrylmethane (106–108) | phenylxylyl ethane | N—phenyl-N—(2-hydroxy-propyl)amine | trisodium nitrilotri-acetate | dark blue |

EXAMPLES 41–47

In Examples 41–44, 2,3,5,6-tetrakis(ethoxycarbonyl)-1,4-benzoquinone(m.p. 149°–150° C.) was used as a color-developing agent, while, also as a color developing agent, 2,5-dibenzoyl-3-bromo-1,4-benzoquinone(m.p. 206°–208° C.) was employed in Examples 45–47. By using such color-developing agents, aqueous coating compositions having the following composition were prepared.

| Composition (Solid Portion) | |
|---|---|
| Kaolin | 50 parts by weight |
| Titanium oxide | 50 parts by weight |
| Sodium salt of styrene-maleic acid copolymer | 2 parts by weight |
| Color-developing agent | 5 parts by weight (used as aqueous suspension) |
| Acrylic resin emulsion (adhesive) | 6 parts by weight |
| Cooked starch binder | 8 parts by weight (used as aqueous solution) |

Similar to Example 23, CF-sheets were prepared. Then, pigment-containing microscopic capsule suspensions were prepared in accordance with the pigment encapsulation method (a) or (c) by using the following compounds as pigments, their solvents, alkanol amines and metal ion sequestering agents. In the same manner as employed in Example 23, CB-sheets were prepared. Similar tests were effected on the combinations of these CF-sheets and CB-sheets. Developed hues are shown in the following table for reference.

| Ex. # | Dyestuff (m.p. °C.) | Dyestuff solvent | Alkanol amine | Metal ion sequestering agent | Hue produced |
|---|---|---|---|---|---|
| 41 | bis(4-dimethylaminophenyl)-1'-ethyl-2'-methylindol-3'-yl-methane (154–156) | diisopropyl naphthalene | tris(2-hydroxyethyl) amine | — | dark purple |
| 42 | 4,4'-dipiperidino-3''-methyl-4''-methoxy-tri-phenylmethane (138–140) | diisopropyl naphthalene | tris(2-hydroxyethyl) amine | tetrasodium ethylenediamine tetraacetate | bluish green |
| 43 | bis-(4-dimethylamino-phenyl)-(3'-methyl-4'-ethoxy)-β-styrylmethane (79–81) | diisopropyl naphthalene | tris(2-hydroxyethyl) amine | — | yellowish green |
| 44 | bis-(4-dimethylamino-phenyl)-2-pyridylmethane (97–100) | diisopropyl naphthalene | tris(2-hydroxyethyl) amine | trisodium N—hydro-xyethyl ethylene-diamine triacetate | yellowish green |
| 45 | bis-(1-ethyl-2-methyl-indol-3-yl)-(3'-methyl-4'-methoxyphenyl-methane (148–152) | diisopropyl naphthalene | tris(2-hydroxyethyl) amine | trisodium N—hydro-xyethyl ethylene-diamine triacetate | red |
| 46 | 4-dimethylaminophenyl-bis (4'-dimethylamino-naphthyl-1')-methane (181–182) | diisopropyl naphthalene | tris(2-hydroxyethyl) amine | — | dark blue |
| 47 | 4,4'-bis(dimethylamino)-3'',4'',5''-trimethoxytri-phenylmethane (121–122) | diisopropyl naphthalene | tris(2-hydroxyethyl) amine | — | green |

EXAMPLE 48

Onto the microscopic capsules of a CB-sheet obtained in Example 23, an aqueous coating composition containing the color-developing agent in Example 23 was applied by a Meyer bar coater in such an amount that the coating was 5 g/m$^2$ in a dry state. The coating was then dried, thereby providing a pressure sensitive recording paper which would produce as a single sheet of paper a color upon application of pressures. The thus-obtained single-sheet pressure sensitive recording paper was white and promptly produced a deep bruish purple color by typing pressures. It showed excellent color fastness.

EXAMPLE 49

To a solvent mixture consisting of 15 parts of nitrocellulose, 30 parts of ethylacetate and 20 parts of methylethylketone, were added as color-developing agents 10 parts of 2,5-diethoxycarbonyl-3,6-di(4'-cyclohexylphenylsulphonyl)-1,4-benzoquinone(m.p. 207°–209° C.), 18 parts of activated alumina and 8 parts of aluminum hydroxide. The mixture was thoroughly stirred to form an oily color-developing ink, which was then spot-printed onto a base web sheet by a gravure printing machine in such an amount that the ink was 3 g/m$^2$ in a dry state. Thus, a spot-printed CF-sheet was prepared. This CF-sheet and a CB-sheet obtained in Example 35 were put together, and, upon application of writing pressures, a fast blue image was obtained at a fast speed.

COMPARATIVE EXAMPLE 1

Various ability and/or property evaluation tests, similar to those conducted in the above examples, were effected on a combination of a CB-sheet and CF-sheet of a commercially available pressure sensitive recording paper ("Fuji Kanatsushi", product of Fuji Photo Film Co., Ltd., Tokyo, Japan), which used CVL and Shilton(terra abla, product of Mizusawa Chemical Industries, Ltd., Osaka, Japan) respectively as a main pressure sensitive dyestuff and a color-developing agent.

Although the above pressure sensitive recording paper produced a blue color, the produced color image was discolored and faded to a green color as the time went on.

COMPARATIVE EXAMPLE 2

Various ability and/or property evaluation tests, similar to those conducted in the above examples, were effected on a combination of a CB-sheet and CF-sheet of a commercially available pressure sensitive recording paper ("Mitsubishi-NCR paper, product of Mitsubishi Paper Mills Ltd.), which used CVL and p-phenylphenol/formaldehyde condensate respectively as a main pressure sensitive dyestuff and a color developing agent.

A blue image developed on the above pressure sensitive recording paper was easily faded upon exposure to light. It was completely vanished upon contact with a polyvinylchloride film containing a plasticizer.

Moreover, the CF-paper of the same pressure sensitive recording paper was very liable to yellow tinge by an exposure to light or $NO_x$.

COMPARATIVE EXAMPLE 3

A dyestuff-containing microscopic capsule suspension was prepared by the microencapsulation method (a) using diisopropylnaphthalene containing 5% by weight of p-anisidine dissolved therein. It was then applied onto a base web sheet to obtain a CB-sheet. A high grade paper was soaked in a 1% acetone solution of 2,3-dichloro-5,6-dicyano-p-benzoquinone and then pulled out of the solution. After drying the thus-soaked paper, a CF-paper was obtained. A pressure sensitive recording paper consisting of the above CB-sheet and CF-sheet produced a light, dark blue color by typing pressures, but its color fastness was extremely poor, thereby making itself totally unsuitable for practical use.

COMPARATIVE EXAMPLE 4

Dibutylphthalate containing, as a dyestuff, 4,4'-bis-dimethylamino-diphenylmethane in an amount of 5% by weight was microencapsulated by the microencapsulation method (a). By using the-thus prepared suspension, a CB-sheet was prepared. Various tests were effected on a combination of the above CB-sheet and a CF-sheet prepared in Example 23. A color image (of a blue color) produced by the pressure sensitive recording paper of this comparative example was discolored and faded along the passage of time and turned to yellowish brown. Thus, it did not have sufficient color fastness against light, thereby making itself unsuitable for practical use.

COMPARATIVE EXAMPLE 5

A pressure sensitive recording paper was prepared from a combination of a CB-sheet prepared in Example 40 and a CF-sheet which contained the commercially available terra abla, Shilton, as a color-developing agent. Typing pressures were applied onto the recording paper. The color-producing speed was however extremely slow. A light blue image was barely recognized as late as several hours later. It took 7 days until the color of the developed image reached its maximum density.

Results of measurement on various abilities and/or properties of the pressure sensitive recording papers obtained in Examples 1–47 and Comparative Examples 1–2 are summarized in Table 1 and Table 2.

TABLE 1

| Various Abilities and Properties as Pressure Sensitive Recording Paper | | | | | | | | |
|---|---|---|---|---|---|---|---|---|
| | Ability and Property of Pressure Sensitive Recording Paper | | | | Degree of Yellow Tinge of CF-sheet | | | |
| Ex. No. | Color-producing Ability (Percentage Color Production) Initial Density | Arrival Density | Color Fastness of Produced Image to Light | Resistance of Produced Image to Plasticizer | Before Test | Exposed to Light | Exposed to $NO_x$ | Degree of Coloration of CB-sheet |
| 1 | 34.2 | 40.2 | 34.3 | 43.4 | 82.1 | 81.9 | 81.8 | 88.0 |
| 2 | 21.3 | 38.4 | 32.1 | 40.1 | 82.1 | 81.9 | 81.8 | 86.7 |
| 3 | 20.0 | 29.9 | 24.3 | 31.4 | 82.1 | 81.9 | 81.8 | 87.4 |
| 4 | 21.4 | 40.0 | 35.8 | 42.3 | 82.1 | 81.9 | 81.8 | 87.5 |
| 5 | 24.3 | 45.9 | 40.0 | 46.4 | 82.1 | 81.9 | 81.8 | 87.0 |
| 6 | 17.3 | 25.4 | 23.8 | 28.3 | 82.1 | 81.9 | 81.8 | 87.5 |
| 7 | 15.9 | 24.9 | 20.9 | 25.9 | 82.1 | 81.9 | 81.8 | 86.9 |
| 8 | 20.1 | 27.8 | 23.5 | 27.9 | 82.1 | 81.9 | 81.8 | 87.2 |
| 9 | 27.4 | 41.1 | 36.0 | 41.9 | 82.1 | 81.9 | 81.8 | 86.5 |
| 10 | 38.2 | 43.8 | 39.4 | 43.8 | 82.3 | 81.2 | 81.8 | 86.9 |
| 11 | 21.8 | 45.8 | 41.2 | 47.5 | 82.3 | 81.2 | 81.8 | 87.1 |
| 12 | 20.4 | 35.9 | 33.2 | 38.0 | 82.3 | 81.2 | 81.8 | 87.2 |
| 13 | 30.2 | 48.6 | 45.1 | 49.0 | 82.3 | 81.2 | 81.8 | 85.8 |
| 14 | 12.4 | 18.2 | 17.8 | 23.0 | 82.3 | 81.2 | 81.8 | 86.5 |
| 15 | 22.5 | 40.4 | 37.4 | 41.6 | 82.3 | 81.2 | 81.8 | 86.7 |
| 16 | 18.5 | 30.4 | 27.5 | 32.3 | 82.3 | 81.2 | 81.8 | 86.6 |
| 17 | 35.8 | 41.4 | 38.2 | 43.4 | 83.5 | 83.0 | 83.2 | 81.5 |

Remarks:

(1) Resistance of Produced Images to Heat: In each of the examples, neither hue nor color density was changed by heat.

(2) Resistance of Produced Images to Water: In each of the examples, good resistance was exhibited.

TABLE 2

| Ex. No. | Various Abilities and Properties as Pressure Sensitive Recording Paper: Ability and Property of Pressure Sensitive Recording Paper: Color-producing Ability (Percentage Color Production): Initial Density | Arrival Density | Color-fastness of Produced Image to Light | Resistance of Produced Image to Plasticizer | Resistance of Produced Image to Heat | Resistance of Produced Image to Water | Degree of Yellow Tinge of CF-sheet: Before Test | Exposed to Light | Exposed to $NO_x$ | Degree of Coloration of CB-sheet: Before Test | Exposed to light |
|---|---|---|---|---|---|---|---|---|---|---|---|
| 23 | 30.9 | 38.5 | 20.7 | 39.0 | Hue and density both unchanged | good | 82.3 | 81.8 | 81.9 | 88.2 | 87.6 |
| 24 | 29.8 | 37.4 | 21.8 | 38.2 | Hue and density both unchanged | good | 82.3 | 81.8 | 81.9 | 88.0 | 86.8 |
| 25 | 20.9 | 31.1 | 19.6 | 31.4 | Hue and density both unchanged | good | 82.3 | 81.8 | 81.9 | 88.4 | 87.4 |
| 26 | 32.4 | 39.5 | 23.1 | 40.0 | Hue and density both unchanged | good | 82.3 | 81.8 | 81.9 | 88.7 | 87.2 |
| 27 | 31.4 | 40.4 | 21.8 | 40.7 | Hue and density both unchanged | good | 82.3 | 81.8 | 81.9 | 88.6 | 87.0 |
| 28 | 21.4 | 30.0 | 17.8 | 31.4 | Hue and density both unchanged | good | 82.3 | 81.8 | 81.9 | 89.0 | 88.1 |
| 29 | 14.8 | 27.4 | 16.5 | 29.4 | Hue and density both unchanged | good | 82.3 | 81.8 | 81.9 | 88.5 | 87.7 |
| 30 | 17.5 | 29.8 | 19.9 | 30.6 | Hue and density both unchanged | good | 82.3 | 81.8 | 81.9 | 87.6 | 86.5 |
| 31 | 24.8 | 30.5 | 21.4 | 31.5 | Hue and density both unchanged | good | 82.3 | 81.8 | 81.9 | 88.9 | 86.1 |
| 32 | 21.5 | 31.8 | 25.4 | 32.2 | Hue and density both unchanged | good | 81.8 | 81.6 | 81.8 | 88.8 | 87.6 |
| 33 | 36.8 | 40.8 | 31.8 | 44.0 | Hue and density both unchanged | good | 81.8 | 81.6 | 81.8 | 89.0 | 88.8 |
| 34 | 29.8 | 36.5 | 26.7 | 37.5 | Hue and density both unchanged | good | 81.8 | 81.6 | 81.8 | 88.9 | 88.7 |
| 35 | 35.0 | 41.0 | 33.5 | 43.1 | Hue and density both unchanged | good | 81.8 | 81.6 | 81.8 | 89.0 | 88.7 |
| 36 | 25.4 | 36.3 | 30.4 | 37.2 | Hue and density both unchanged | good | 81.8 | 81.6 | 81.8 | 88.9 | 88.4 |
| 37 | 31.8 | 40.9 | 31.8 | 41.1 | Hue and density both unchanged | good | 81.8 | 81.6 | 81.8 | 89.0 | 88.5 |
| 38 | 15.2 | 23.4 | 17.9 | 27.8 | Hue and density both unchanged | good | 81.8 | 81.6 | 81.8 | 89.0 | 88.8 |
| 39 | 23.4 | 34.5 | 20.9 | 34.8 | Hue and density both unchanged | good | 81.8 | 81.6 | 81.8 | 89.1 | 88.9 |
| 40 | 21.8 | 35.8 | 29.7 | 37.0 | Hue and density both unchanged | good | 81.8 | 81.6 | 81.8 | 88.9 | 88.8 |
| 41 | 18.6 | 29.9 | 23.7 | 31.3 | Hue and density both unchanged | good | 81.6 | 81.3 | 81.5 | 88.1 | 86.9 |
| 42 | 24.8 | 33.4 | 28.8 | 35.0 | Hue and density both unchanged | good | 81.6 | 81.3 | 81.5 | 88.9 | 88.7 |
| 43 | 29.5 | 37.2 | 31.9 | 38.8 | Hue and density both unchanged | good | 81.6 | 81.3 | 81.5 | 89.0 | 88.1 |
| 44 | 19.0 | 28.5 | 24.9 | 30.4 | Hue and density both unchanged | good | 81.6 | 81.3 | 81.5 | 88.4 | 88.0 |
| 45 | 14.8 | 23.2 | 19.8 | 23.6 | Hue and density both unchanged | good | 81.9 | 81.6 | 81.8 | 89.0 | 88.6 |
| 46 | 24.3 | 31.6 | 24.5 | 32.2 | Hue and density both unchanged | good | 81.9 | 81.6 | 81.8 | 88.8 | 87.9 |
| 47 | 29.8 | 34.6 | 29.8 | 35.8 | Hue and density both unchanged | good | 81.9 | 81.6 | 81.8 | 88.7 | 87.4 |
| 1* | 18.8 | 26.9** | 14.1** | 23.0** | Changed to green | vanished | 82.1 | 78.4 | 79.4 | 89.0 | 88.6 |
| 2* | 22.8 | 32.5 | 6.8 | 4.1 (vanished) | Developed image vanished | good | 77.6 | 68.4 | 64.1 | 87.3 | 78.4 |

Remarks:
*Comparative Example
**The produced image was gradually turned to green along the passage of time.

What is claimed is:

1. A pressure sensitive recording unit comprising a single base web sheet and a colorless or light-colored methine-type dyestuff represented by the formula (I):

$$X-\overset{\overset{\displaystyle Y}{|}}{C}H-Z \qquad (I)$$

wherein, X, Y and Z represent individually a phenyl, naphthyl, or $\beta$-styryl group or a residue of an aromatic heterocyclic ring which group or ring may optionally be substituted, X, Y and Z may be the same or different, and either two of X, Y and Z may be coupled together to form a ring, and an organic oxidizing compound selected from oxidizing quinone derivatives substituted by a multiplicity of electron attractive groups, both the dyestuff and the oxidizing compound being supported on the single base web sheet; or a combination of a first base web sheet on which said methine-type dyestuff is supported and a second base web sheet on which said organic oxidizing compound is supported.

2. The pressure sensitive recording unit according to claim 1, wherein the methine-type dyestuff is supported together with an alkanol amine on its base web sheet.

3. The pressure sensitive recording unit according to claim 1, wherein the methine-type dyestuff is supported together with an alkanol amine and a metal ion sequestering agent on its respective base web sheet.

4. A pressure sensitive recording unit comprising, in combination:

(A) a first sheet carrying thereon a layer which contains (a) microscopic capsules enclosing a solution of a colorless or light-colored methine-type dyestuff represented by the general formula (I):

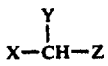

(I)

wherein, X, Y and Z represent individually a phenyl, naphthyl, or β-styryl group or a residue of an aromatic heterocyclic ring which group or ring may optionally be substituted, X, Y and Z may be the same or different, and either two of X, Y and Z may be coupled together to form a ring, and (b) an alkanol amine and/or metal ion sequestering agent; and (B) a second sheet carrying thereon a layer containing an organic oxidizing compound selected from oxidizing quinone derivatives substituted by a multiplicity of electron attractive groups.

5. A pressure sensitive recording unit comprising a single base web sheet; and a layer supported on a same surface of the single base web sheet and containing (a) microscopic capsules enclosing a colorless or light-colored solution of a methine-type dyestuff represented by the general formula (I):

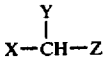

(I)

wherein, X, Y and Z represent individually a phenyl, naphthyl, or β-styryl group or a residue of an aromatic heterocyclic ring which group or ring may optionally be substituted, X, Y and Z may be the same or different, and either two of X, Y and Z may be coupled together to form a ring, (b) an alkanol amine and/or metal ion sequestering agent, and (c) an organic oxidizing agent selected from oxidizing quinone derivatives substituted by a multiplicity of electron attractive groups.

6. The pressure sensitive recording unit according to any one of claims 1, 4 or 5, wherein the methine-type dyestuff has been microencapsulated as a solution of a hydrophobic solvent having a high boiling point.

7. The pressure sensitive recording unit according to claim 6, wherein the methine-type dyestuff is a triphenylmethane-type dyestuff.

8. The pressure sensitive recording unit according to any one of claims 1, 4 or 5, wherein the organic oxidizing compound has its oxidation-reduction potential at 0.4 eV.

9. The pressure sensitive recording unit according to any one of claims 1, 4 or 5, wherein the organic oxidizing compound is a 2,3,5,6-tetra-substituted-1,4-benzoquinone.

10. The pressure sensitive recording unit according to claim 4 or 5, wherein the alkanol amine is a tertiary alkanol amine.

11. The pressure sensitive recording unit according to claim 4 or 5, wherein the metal ion sequestering agent is a water-soluble organic metal ion sequestering agent.

12. The pressure sensitive recording unit according to claim 4 or 5, wherein the metal ion sequestering agent is a polyphosphate.

* * * * *